US010791826B2

(12) United States Patent
Crowe et al.

(10) Patent No.: US 10,791,826 B2
(45) Date of Patent: Oct. 6, 2020

(54) ADJUSTABLE HEIGHT DESK SYSTEM

(71) Applicant: Twin-Star International, Inc., Delray Beach, FL (US)

(72) Inventors: Matthew Crowe, Guangdong (CN); Wally Wang, Guangdong (CN)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 0 days.

(21) Appl. No.: 15/943,020

(22) Filed: Apr. 2, 2018

(65) Prior Publication Data

US 2018/0279770 A1 Oct. 4, 2018

Related U.S. Application Data

(60) Provisional application No. 62/479,741, filed on Mar. 31, 2017, provisional application No. 62/488,144, filed on Apr. 21, 2017, provisional application No. 62/570,868, filed on Oct. 11, 2017.

(51) Int. Cl.

| | |
|---|---|
| ***A47B 9/16*** | (2006.01) |
| ***A47B 13/12*** | (2006.01) |
| ***A47B 21/02*** | (2006.01) |
| ***A47B 13/08*** | (2006.01) |
| ***A47B 9/10*** | (2006.01) |
| *A47B 9/18* | (2006.01) |

(52) U.S. Cl.

CPC ..... *A47B 9/16* (2013.01); *A47B 9/10* (2013.01); *A47B 13/086* (2013.01); *A47B 13/12* (2013.01); *A47B 21/02* (2013.01); *A47B 2009/185* (2013.01); *A47B 2200/0056* (2013.01); *A47B 2200/0062* (2013.01)

(58) Field of Classification Search

CPC ..... A47B 9/00; A47B 9/04; A47B 2009/043; A47B 13/086; A47B 13/12; A47B 2200/0078; A47B 2200/0079; A47B 2200/008; A47B 2200/0057

USPC ..... 108/147, 147.19

See application file for complete search history.

(56) References Cited

U.S. PATENT DOCUMENTS

| | | | | |
|---|---|---|---|---|
| 5,601,037 A * | 2/1997 | Meyer | A47B 9/04 | 108/147 |
| 6,595,144 B1 * | 7/2003 | Doyle | A47B 9/00 | 108/147 |
| 6,758,518 B2 * | 7/2004 | Ingram | B60N 3/004 | 108/44 |
| 8,547,057 B2 * | 10/2013 | Dunworth | H02J 7/0071 | 320/108 |
| 8,991,320 B2 * | 3/2015 | DesRoches | A47B 21/02 | 108/50.01 |

(Continued)

*Primary Examiner* — Jose V Chen

(74) *Attorney, Agent, or Firm* — McDonald Hopkins LLC

(57) ABSTRACT

Disclosed is a desk system having a freestanding leg assembly, a frame being attachable to an upper portion of the freestanding leg assembly and an adjustable height desktop platform comprising a table top and a supporting leg assembly. The supporting leg assembly may extend between the frame and the table top and the supporting leg assembly may have a scissor lift for adjusting the height of the table top away from the freestanding leg assembly. Disclosed is a desk system having a telescoping leg assembly, configured to adjustable raise or lower a table top of the desk. Disclosed is a desk system with an interface to power the adjustable desk, wherein the interface is visible and operable through the table top.

16 Claims, 29 Drawing Sheets

(56) References Cited

U.S. PATENT DOCUMENTS 9,701,409 B2 * 7/2017 Valdes ..... B64D 11/0015
9,723,920 B1 * 8/2017 Wu ..... A47B 21/02
D812,947 S * 3/2018 Tseng ..... D6/708
2008/0115697 A1 * 5/2008 Beam ..... A47B 13/08 108/26
2008/0178779 A1 * 7/2008 Agee ..... A47B 9/04 108/147
2011/0061570 A1 * 3/2011 Klinke ..... A47B 9/20 108/20
2012/0126072 A1 * 5/2012 Pettersson ..... A47B 9/04 248/157
2014/0060395 A1 * 3/2014 Ruiter ..... A47B 13/081 108/50.02
2014/0336822 A1 * 11/2014 Kristensen ..... G05B 15/02 700/275
2015/0138304 A1 * 5/2015 McArdell ..... A47B 21/00 348/14.07
2016/0051042 A1 * 2/2016 Koch ..... A47B 9/00 248/550
2016/0128467 A1 * 5/2016 Sigal ..... A47B 9/00 700/275
2016/0170402 A1 * 6/2016 Lindstrom ..... A47B 9/00 700/275
2016/0260019 A1 * 9/2016 Riquelme Ruiz .... A47B 21/007
2016/0345722 A1 * 12/2016 Chen ..... A47B 9/04
2016/0360879 A1 * 12/2016 Kelley ..... A47B 21/06
2017/0052517 A1 * 2/2017 Tsai ..... A47B 9/00
2017/0099943 A1 * 4/2017 Joshi ..... B60B 33/021
2017/0251802 A1 * 9/2017 Lu ..... A47B 3/06
2017/0303679 A1 * 10/2017 Tseng ..... A47B 9/04
2017/0354244 A1 * 12/2017 Lee ..... A47B 9/20
2018/0184799 A1 * 7/2018 Lin ..... A47B 17/02
2018/0270911 A1 * 9/2018 Debreyer ..... A47B 13/12
2019/0029412 A1 * 1/2019 Gibson ..... H04Q 9/04
2019/0125075 A1 * 5/2019 Soulliere ..... G06F 1/20
2019/0200751 A1 * 7/2019 Yamamoto ..... A47B 9/00
2019/0223586 A1 * 7/2019 Hansen ..... A47B 9/00
2019/0335896 A1 * 11/2019 Hansson ..... A47B 21/03

* cited by examiner

ADJUSTABLE HEIGHT DESK SYSTEM

CROSS-REFERENCE TO RELATED APPLICATIONS

This application claims priority to Provisional Patent Application No. 62/479,741 entitled "ADJUSTABLE HEIGHT DESK" filed on Mar. 31, 2017, which is hereby incorporated by reference in its entirety. This application claims priority to Provisional Patent Application No. 62/488,144 entitled "ADJUSTABLE HEIGHT DESKTOP PLATFORM" filed on Apr. 21, 2017 and is hereby incorporated by reference in its entirety. This application claims priority to Provisional Patent Application No. 62/570,868 entitled "ADJUSTABLE HEIGHT DESK SYSTEM" filed on Oct. 11, 2017 and is hereby incorporated by reference in its entirety.

FIELD OF INVENTION

The present disclosure relates generally to a desk system that includes an adjustable height.

BACKGROUND

Desks in which the height of the table top is adjustable are well known. Additionally, platforms that are positionable on top of a desktop and which have an adjustable height, so as to provide a work surface that has a variable vertical position above the desktop, are also known. Some versions of such platforms are referred to as "standing desks," which are movable between at least two height positions relative to the desktop so that a user can use the work surface in both a seated and a standing position.

Despite various improvements in the design of adjustable height desk systems, still further improvement would be desirable.

BRIEF DESCRIPTION OF THE DRAWINGS

Operation of the systems described in the present disclosure may be better understood by reference to the detailed description taken in connection with the following illustrations. These drawings form part of this specification, and any written information in the drawings should be treated as part of this disclosure. In the same manner, the relative positioning and relationship of the components as shown in these drawings, as well as their function, shape, dimensions, and appearance, may all further inform certain aspects of the present disclosure as if fully rewritten herein. In the drawings.

SUMMARY

Figure 1:
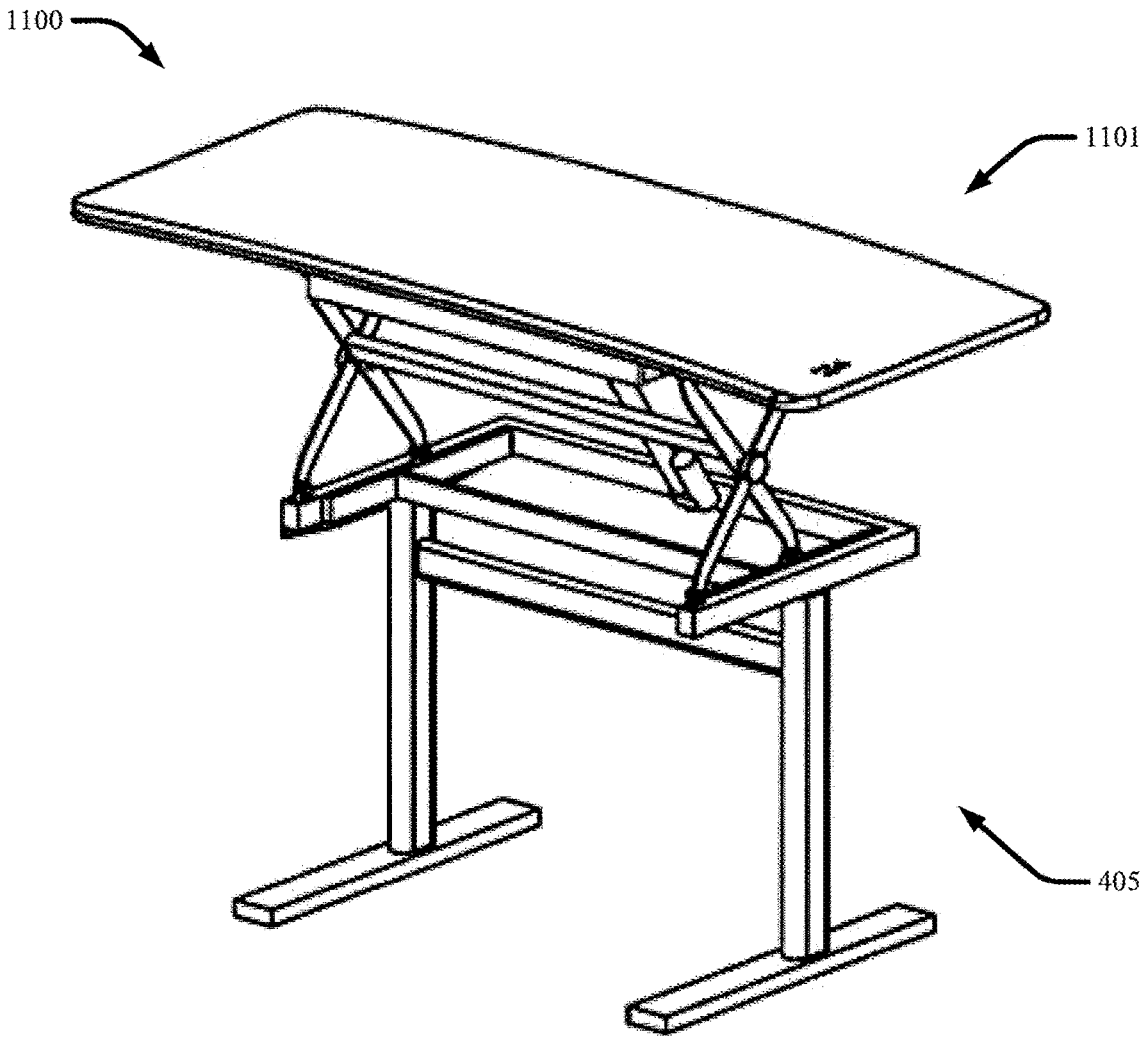
FIG. 1 is a perspective view of an adjustable height desk system in accordance with one embodiment of the present technology.

The following presents a summary of this disclosure to provide a basic understanding of some aspects. This summary is not intended to identify key or critical elements or define any limitations of embodiments or claims. Furthermore, this summary may provide a simplified overview of some aspects that may be described in greater detail in other portions of this disclosure.

In an embodiment, disclosed is a desk system having a freestanding leg assembly, a frame being attachable to an upper portion of the freestanding leg assembly, and an adjustable height desktop platform having a table top and a supporting leg assembly. The supporting leg assembly may extend between the frame and the table top and the supporting leg assembly may have a scissor lift for adjusting the height of the table top away from the freestanding leg assembly. Further, the scissor lift may be configured to be mounted on top of the frame.

In an embodiment, disclosed is a desk system having a freestanding desk assembly having a support structure and an upper structure mounted on top of the support structure, said upper structure having a compartment that is open at the top. The desk system may have an adjustable height desktop platform having a table top and a supporting leg assembly where the supporting leg assembly extends between a bottom section of the compartment and the table top. Further, the supporting leg assembly may include a scissor lift for adjusting the height of the table top away from the desk assembly where the scissor lift is configured to be mounted on the bottom section of the compartment.

In an embodiment, disclosed is a desk system having an adjustable configuration. The desk system includes a table top having an upper surface and a supporting leg assembly connected to the table top for supporting the table top off of a floor surface on which the leg assembly is positioned. The table top may include an interface adapted to be activated by a user to power the adjustment of at least one configuration of the desk, the interface being flush with the upper surface of the table top.

In an embodiment, disclosed is a desk system with an adjustable configuration. The desk system includes a table top with an upper surface and an opposite lower surface. The desk system may also include a control module positioned against the lower surface of the table top. The control module may feature an interface that is viewable from above the top surface of the table top and at least one button of the control module is operatively activatable through the top surface of the table top. The table top may be made of glass. The table top may feature a pigment or veneer finish.

The following description and the drawings disclose various illustrative aspects. Some improvements and novel aspects may be expressly identified, while others may be apparent from the description and drawings.

DETAILED DESCRIPTION

Reference will now be made in detail to exemplary embodiments of the present disclosure, examples of which are illustrated in the accompanying drawings. It is to be understood that other embodiments may be utilized and structural and functional changes may be made without departing from the respective scope of the present disclosure. Moreover, features of the various embodiments may be combined or altered without departing from the scope of the present disclosure. As such, the following description is presented by way of illustration only and should not limit in any way the various alternatives and modifications that may be made to the illustrated embodiments and still be within the spirit and scope of the present disclosure.

FIG. 1 illustrates an embodiment of an adjustable desk system 1100 in accordance with the instant disclosure. The adjustable desk system 1100 may include an adjustable height desktop platform 1101 and a freestanding leg assembly 405. The embodiment illustrated in FIG. 1 will be explained in more detail with reference to FIGS. 19-21.

Figure 4:
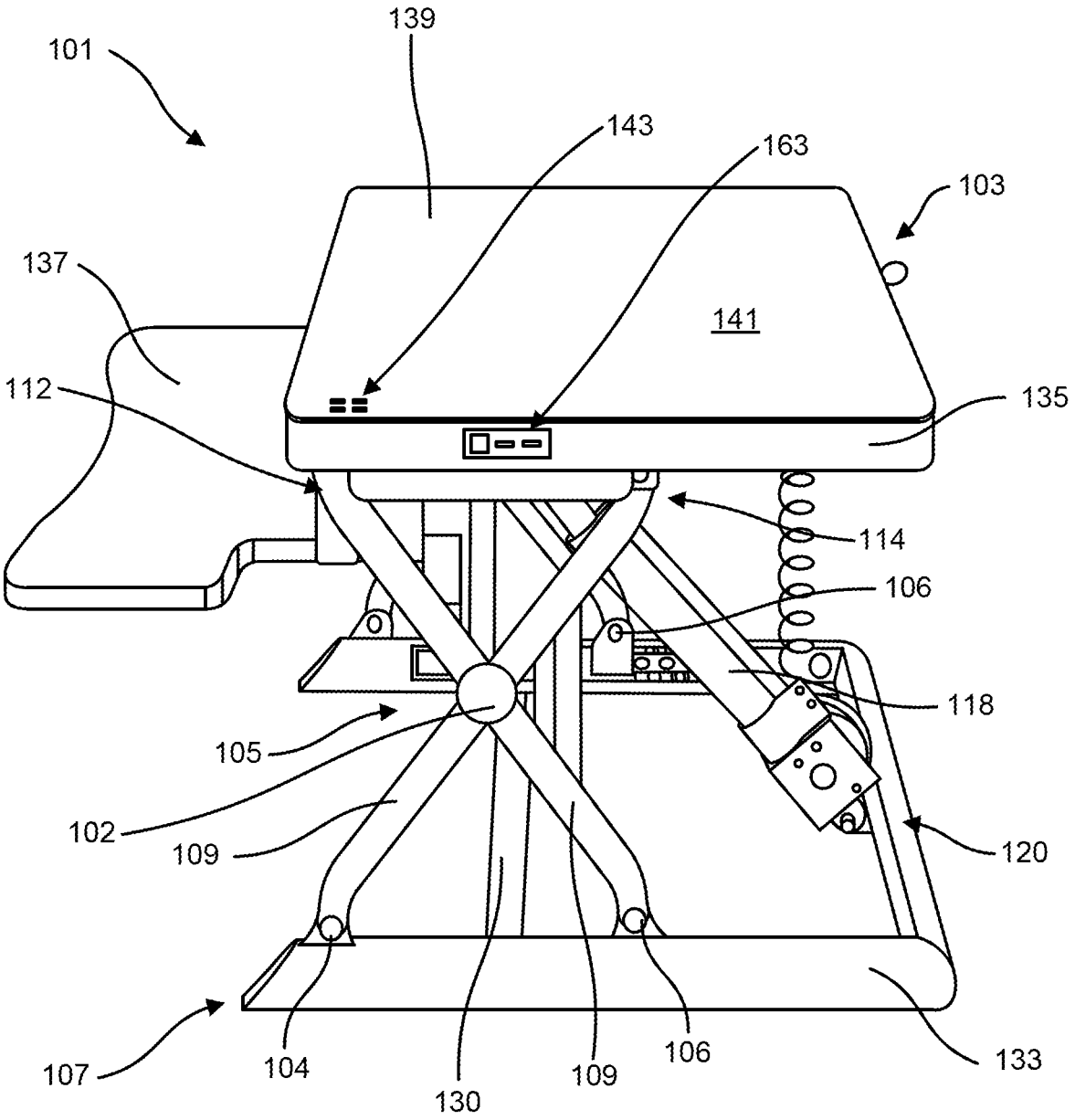
FIG. 4 is a side view of the embodiment of FIG. 2 in an extended configuration.
Figure 5:
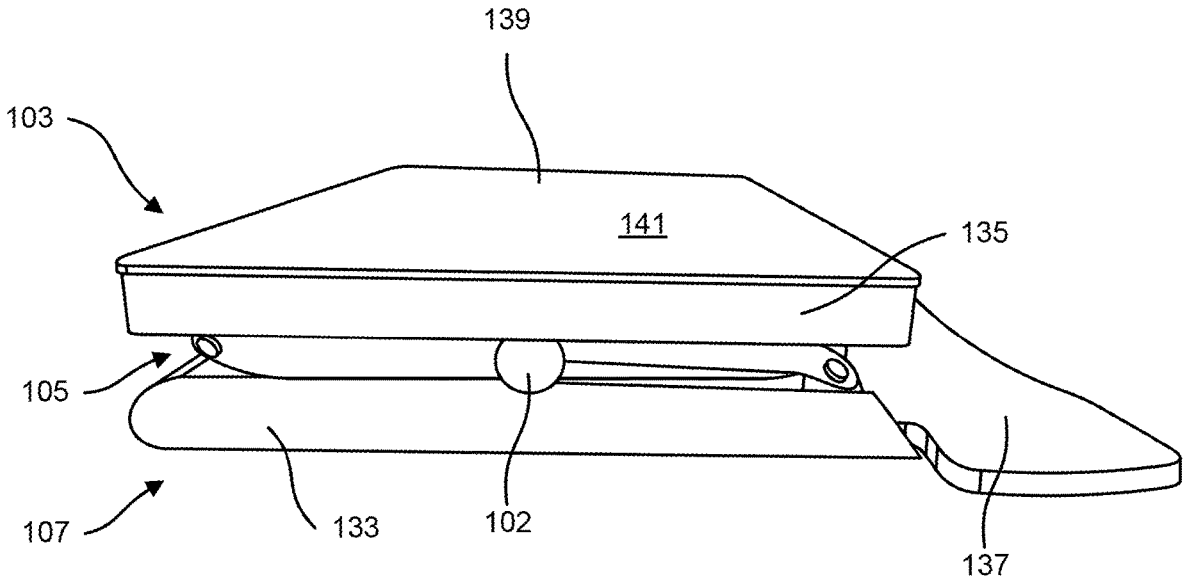
FIG. 5 is a side view of the embodiment of FIG. 2 in a collapsed configuration.
Figure 6:
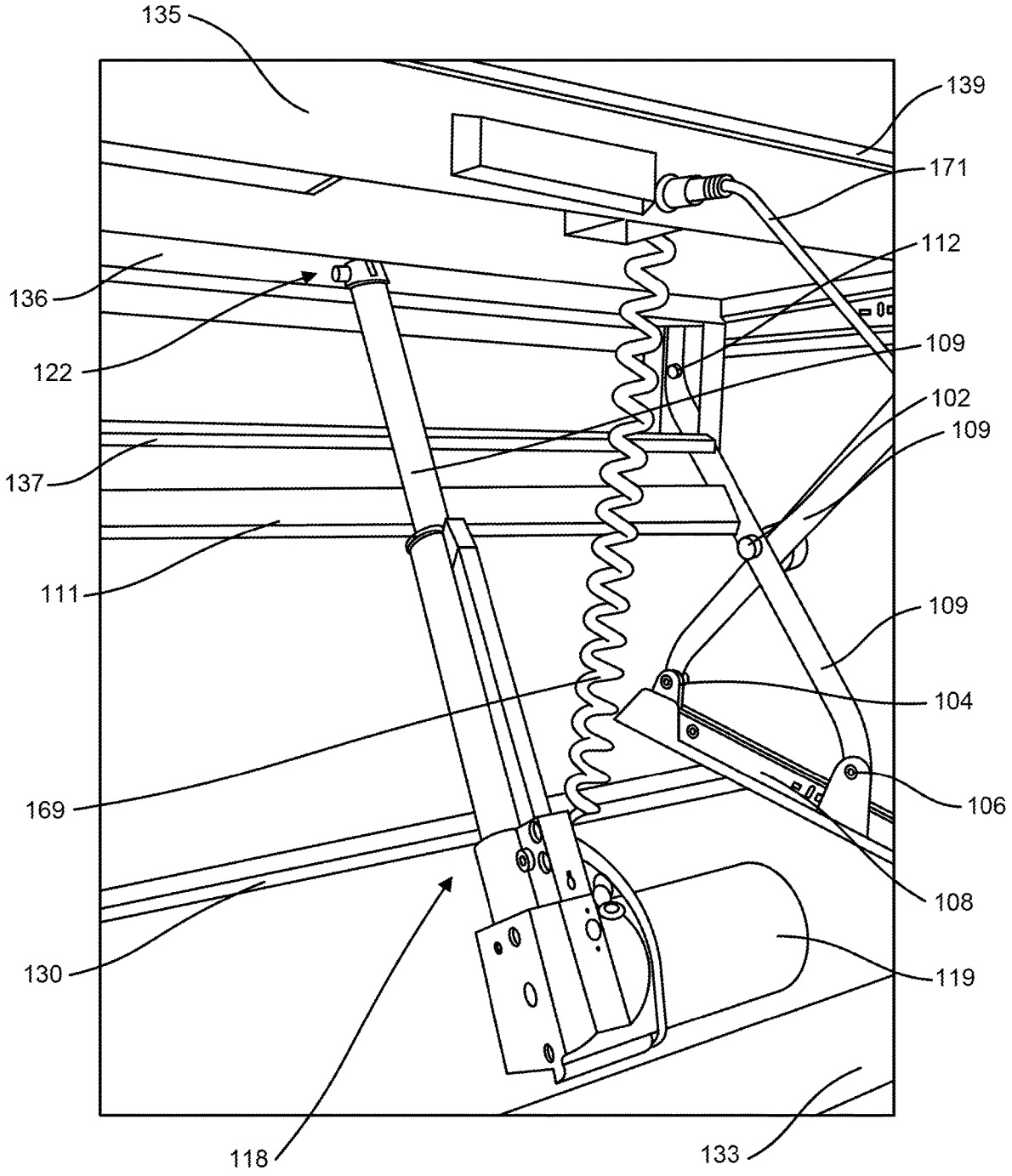
FIG. 6 is a perspective view of a portion of the underside of the embodiment of FIG. 2 in an extended configuration.

An adjustable height desktop platform 101 in accordance with an embodiment of the present technology is shown in FIGS. 2-7. The platform includes a table top assembly 103, a leg assembly 105, and a base 107. On each side of the platform 101, the leg assembly 105 may include two crisscrossing linkages 109 extending between the table top assembly 103 and the base 107, which crisscrossing linkages 109 may be arranged similarly to a scissor lift. Alternatively, the legs may be a telescoping design as discussed later. The leg assembly 105 may also include one or more horizontal cross bars 111 connecting the linkages 109 on each side, as shown in FIG. 6, in order to stabilize and strengthen the leg assembly 105. The base 107 may include a fully or partially enclosed frame structure 133 designed to rest stably on the top surface of a piece of furniture (e.g., a desk or table), and one or more cross pieces 130 may be provided to stiffen the frame structure.

Figure 2:
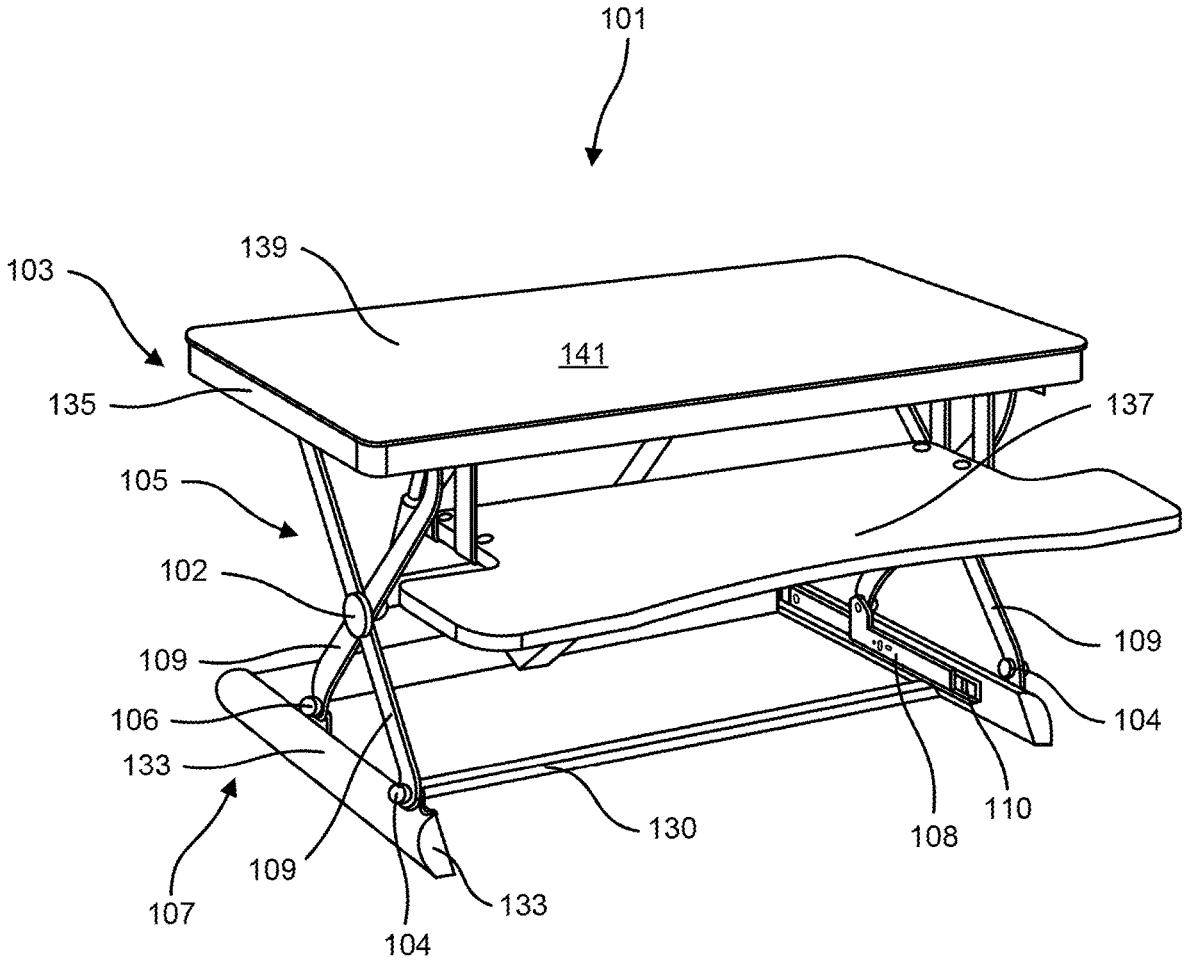
FIG. 2 is a perspective view of an adjustable height desktop platform in accordance with one embodiment of the present technology in an extended configuration.
Figure 3:
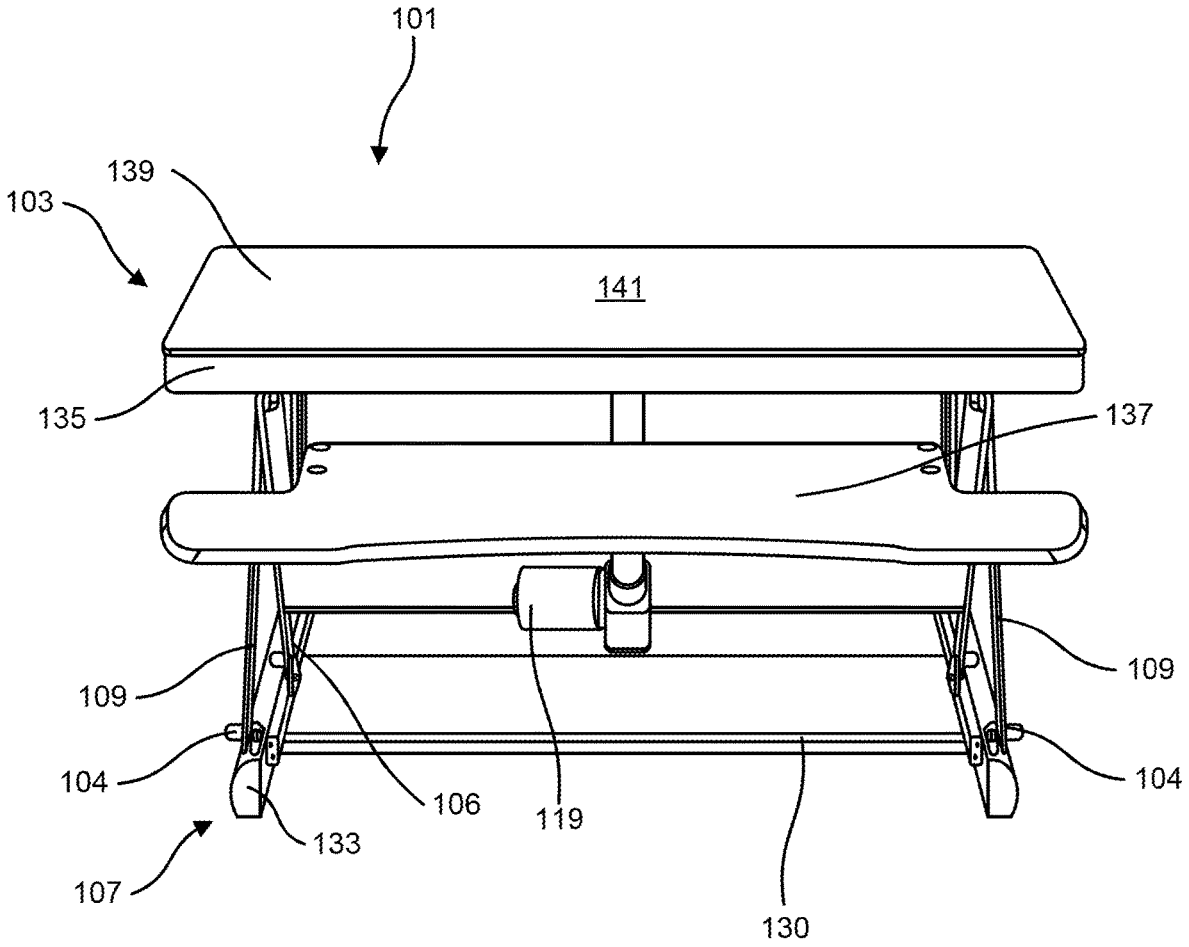
FIG. 3 is a front view of the embodiment of FIG. 2 in an extended configuration.

The platform 101 may be adjustable so as to vary the height of the table top assembly 103 from the base 107, and in turn the top surface of the furniture on which the base 107 is positioned. For example, the platform 101 may be adjustable between a collapsed configuration, as shown in FIG. 5, and a fully extended configuration, as shown in FIGS. 2-4, as well as any number of intermediate positions. In order to permit the movement of the platform 101 between the various heights, the crisscrossing linkages 109 of the leg assembly 105 may be pivotably connected together at a central pivot point 102, and the lower ends of each linkage 109 may be pivotably connected to the base 107. Specifically, the lower front end 104 of the crisscrossing linkages 109 on each side of the platform 101 may be pivotably fixed to the frame structure 133 of the base 107, and the lower rear end 106 of the crisscrossing linkages on each side of the platform 101 may be pivotably connected to the frame structure 133 in such a way that the lower rear ends 106 can translate forwards and backwards along the base 107. For example, the lower rear ends 106 can be pivotably connected to respective rails 108 that are slidably guided along tracks 110 on the frame structure 133 of the base 107. The interaction of the rails 108 and tracks 110 may be similar to standard drawer slides, such as by including ball bearings between the rails and tracks in order to ease the movement of the components.

The table top assembly 103 may be comprised of multiple components. For example, the table top assembly 103 may include an apron 135 and a top 139. The thickness of the outer edge of the apron 135 may act as a framing structure that provides stiffness and strength to the table top assembly 103, and the apron 135 may also include additional internal framing components. The thickness provided by the apron 135 and any internal framing structure may also permit the table top assembly 103 to house various components, such as a drawer (not shown) and/or various electrical components, as discussed later. In one embodiment, the apron 135 may be constructed from steel, while the top 139 may be comprised of a planar piece of glass, although other materials may also be suitable. For example, the apron 135 could alternatively be constructed from aluminum or other metals. In an embodiment, the apron 135 could be constructed from a metal-wood or wood composite or from solid wood.

The upper ends of each linkage 109 may be pivotably connected to the table top assembly 103 in a similar manner to the connections to the base 107. For example, the upper front end 112 of the crisscrossing linkages 109 on each side of the platform 101 may be pivotably fixed to the apron 135, and the upper rear end 114 of the crisscrossing linkages on each side of the platform 101 may be pivotably connected to the apron 135 in such a way that the upper rear ends 114 can translate forwards and backwards along the table top assembly 103. For example, the upper rear ends 114 can be pivotably connected to respective rails 108 that are slidably guided along tracks 110 attached to the apron 135 in a similar manner to the base 107. The interaction of those rails 108 and tracks 110 may also be similar to standard drawer slides, such as by including ball bearings between the rails and tracks to ease the movement of the components.

The height adjustment of the table top assembly 103 may be driven by a mechanical height adjustment assembly that may be electrically powered and controlled. For example, the height adjustment assembly may include a pneumatic linear piston 118 powered by a motor 119. The lower end 120 of the piston 118 may be pivotably connected to the frame structure 133 of the base 107, as shown in FIG. 4, and the upper end 122 of the piston 118 may be pivotably connected to the table top assembly 103, such as by connecting to a crossbar 136 of the internal framing structure of the apron 135. In that way, the piston 118 can pivot with respect to both the base 107 and the table top assembly 103 as the piston 118 extends and retracts to drive the height adjustment of the platform 101.

In an effort to increase safety and reduce the risk of a foreign object, such as a user's finger or other appendage, becoming trapped by the linkages 109 as they are collapsing, one or more sensors may be included in the platform 101 to send a signal to a control module 153 (discussed below) to stop movement of the platform when such a foreign object is detected. For example, one or more sensors (not shown) may be provided on the underside of the table top assembly 103 facing downwards, so as to detect the presence of a foreign object below them. Such sensors may be optical sensors, such as photoelectric sensors. Multiple sensors may be provided to create a light curtain between the table top assembly 103 and the base 107, at least along the length of the linkages 109. Thus, when one of the sensors detects the presence of a foreign object, the sensor desirably provides a signal to stop further movement of the piston 118 in the current extension or retraction direction.

The table top assembly 103 may further include a shelf 137, which may be suspended below the apron 135 of the table top assembly. The shelf 137 may be designed to support a keyboard and/or a computer mouse, for example, while the top surface 141 of the table top assembly may be designed to support one or more computer monitors, speakers, a laptop, and/or a laptop dock. The top surface 141 of the top assembly may also be designed with specific features, including a holder for writing utensils, an inbox, or other desktop accessories. Further, the top surface 141 may be able to write on and easily remove with dry erase markers, be magnetic or feature other helpful characteristics for users.

Figure 7:
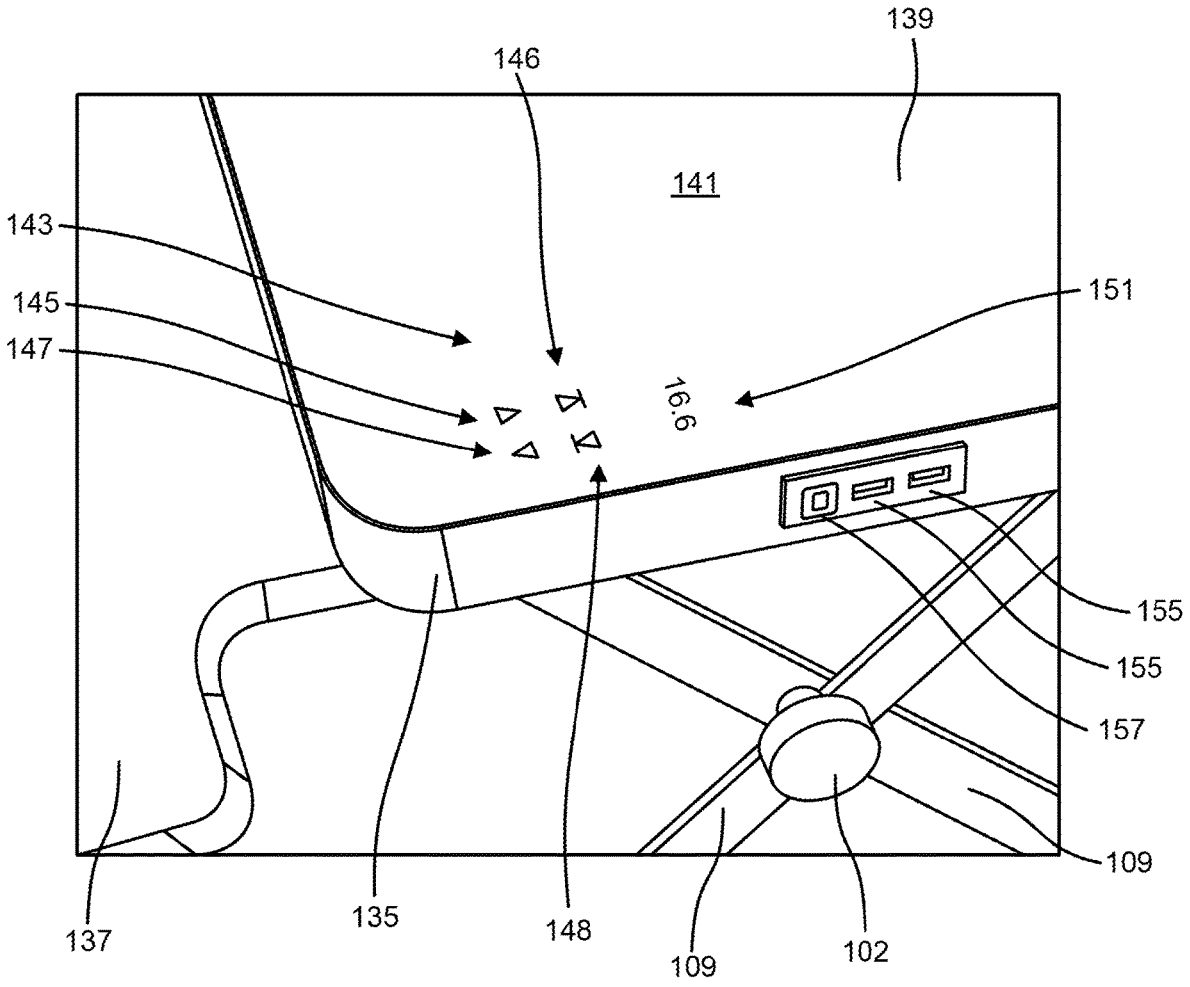
FIG. 7 is a perspective view of a portion of the table top assembly of the embodiment of FIG. 2.

The top surface 141 of the table top assembly 103, which may be provided by the planar top of the glass top 139, desirably provides an interface 143 for controlling and/or displaying various aspects and/or information regarding the configuration of the platform 101. For example, as shown in FIG. 7, the interface 143 may include one or more buttons for activation by a user in order to change one or more adjustable configurations of the platform. In one example, the adjustable configuration may be the height of the table top assembly 103, which, as discussed above, may be actuated by a height adjustment assembly including a piston 118. In such an example, an 'up' button 145 and a 'down' button 147 may be provided in the interface 143 in order to drive the motor 119 in the appropriate direction so as to raise or lower the table top assembly 103 upon actuation of the button by the user. Moreover, in such an example, one or more 'memory' buttons 149 (see example in FIGS. 8 and 9) may be included in the interface, in order to store pre-programmed or user-programmable height set points for the table top assembly 103. The interface 143 may also include a 'top' button 146 and a 'bottom' button 148 for automatically driving the table top assembly 103 to the maximum extension and maximum collapse positions, respectively, when activated. In another example, the adjustable configuration may be the angle of the table top assembly 103. In such an example, a forward and a backward button (not shown), as well as optional 'memory' buttons (also not shown), may be provided for controlling an appropriate electrically-powered, mechanical system for driving the adjustment in the angle of the table top assembly.

The interface 143 may also include one or more displays 151 for providing information regarding an adjustable configuration of the platform 101. For example, the display 151 may be a digital display that provides a numerical indication of the current height of the table top assembly 103. In an alternative embodiment (not shown), the display may provide a qualitative indication of the current height of the table top assembly 103, such as by providing a graphical slider (e.g., comprising an array of LEDs) to indicate an amount of expansion of the table top relative to the maximum and minimum heights. In another alternative, a display of the interface 143 may provide other information, such as the status of one or more electrical components wired into the platform 101 (e.g., lights, speakers, USB charging ports, outlets, a heating and/or cooling function of a desk component like a cupholder, etc.), or an error code to provide information regarding what component of the platform may be malfunctioning, in the event of a malfunction. The display 151 may also provide other information independent of the platform configuration, such as the ambient temperature in the room.

In an embodiment, the interface 143 may be flush with the top surface 141 of the table top assembly 103, which will desirably interfere less with items placed on the top surface 141. One way of accomplishing such a flush configuration is to recess a control module 153 that provides the interface 143 under the top surface 141, such that the interface 143 itself is flush with the top surface 141. In another alternative, the module 153 can be positioned underneath the top 139 and abutting the underside of the top 139, such that when the user presses an appropriate location on the top surface 141, the buttons 145, 146, 147, 148, 149 are activated. For example, the buttons may be capacitive buttons, such that the user can activate a desired button by pressing a finger on the top surface 141 of the glass top 139 directly above the button. In order to facilitate the operation of the capacitive buttons through the glass top 139, the top 139 may desirably have a thickness between about 6 mm and about 10 mm. Alternatively, in order to provide for improved capacitive operation without sacrificing the structural integrity of the glass top 139, the top 139 may be a composite of two layers of glass (e.g., each about 3 mm thick) bonded together, and the lower layer of glass may include a hole through it to receive the module 153 so that the thickness of the glass directly above the capacitive buttons is only about 3 mm. In another alternative, the lower layer of glass in the composite could instead be a layer of a different material (e.g., metal) that provides structural support to the upper layer of glass. It is noted that the layers of the composite tops discussed above need not be bonded together. In yet another alternative, the lower layer of the composite could be replaced with a framing structure that provides structural support to the relatively thin upper layer of glass, and the framing structure could be directly or indirectly connected to the module 153.

By arranging the module 153 underneath the top 139 and abutting the underside of the top 139, the display 151 may also be visible by the user through the glass top 139. The glass top 139 may also be designed in such a way as to complement the buttons and/or display. For example, the underside of the glass top 139 may have a semi-transparent/semi-opaque coating, so as to obscure components underneath the top 139 (including the module 153), while still allowing the user to view the abutting display 151 through the glass top 139. In one example, the coating on the underside of the glass top 139 may be a layer of paint or other pigment applied in a silkscreen process. In one example, the coating may be a veneer. Since the glass top 139 may be attached to the table top assembly 103 by bonding it to apron 135 or another part of the platform 101, which might involve a heat-sealing type of bonding, the layer of paint applied to the underside of the glass top 139 may be a high temperature paint. Such high temperature paint may be applied to the entire underside except for an area directly above the display 151, which may separately have a low-temperature translucent paint applied to it in a separate silkscreen process. That low-temperature translucent paint may have the same color as the high temperature paint, in order to provide a uniform look to the glass top 139 when viewed from above. The display 151 may comprise an illuminated seven-segment display that is visible through the glass (e.g., through the translucent, low temperature paint applied to the underside in a silkscreen process, as described above). The glass top 139 may also include patterns to identify the buttons of the module 153 positioned beneath it. For example, symbols and characters representing the up, down, top, bottom, and memory buttons 145, 146, 147, 148, 149 may be printed on the top surface 141 or on the underside of the glass top 139, or those symbols and characters may simply be defined by non-coated/painted patterns on the otherwise painted underside of the glass top 139.

Any or all of the buttons 145, 146, 147, 148, 149 may also (or alternatively) be illuminated by the module 153, in order to increase visibility. The module 153 can be programmed to turn on and off the illumination of the buttons 145, 146, 147, 148, 149 and/or the display 151 (e.g., by having the illumination fade out or fade in). For example, the illumination of the buttons and display can turn on or fade in when the buttons are activated by the user, and the buttons and display can turn off or fade out after a certain pre-set amount of time has elapsed since the buttons were activated by the user. That way, the illumination of the buttons and display is turned off when not in use, in order to save power and reduce any distraction that might be caused by such illumination.

Along the side of the apron 135, adjacent to the interface 143, may be provided one or more ports 155, such as USB ports, cable ports, electrical outlets or headphone jacks. Such ports 155 may primarily be for charging devices plugged into them, but they may also (or alternatively) be for providing data connections between such devices. Adjacent to the ports 155 may be a locking control 157 in the form of a button or switch. The locking control 157 may be activated by the user in order to disable (or enable) the various buttons 145, 146, 147, 148, 149 on the top surface 141, so that the buttons are not accidentally activated when not desired by the user. The module 153 may be programmed to vary the way in which the buttons 145, 146, 147, 148, 149 and/or display 151 are illuminated when the locking control 157 is activated, in order to provide a visual indication to the user that the locking control 157 is in an activated mode. As an example, the buttons 145, 146, 147, 148, 149 will not be operable when the locking control 157 is activated, but, when the user attempts to activate the buttons, the illumination of the buttons and/or display may fade-in much more quickly (or even instantaneously) compared to when the locking control 157 is not activated, or the illumination might instead blink, in order to clearly indicate to the user that the locking control 157 is currently activated. This locking control 157 may prevent the desk system from becoming engaged when a user or other person, animal or objects touches the buttons.

Figure 8:
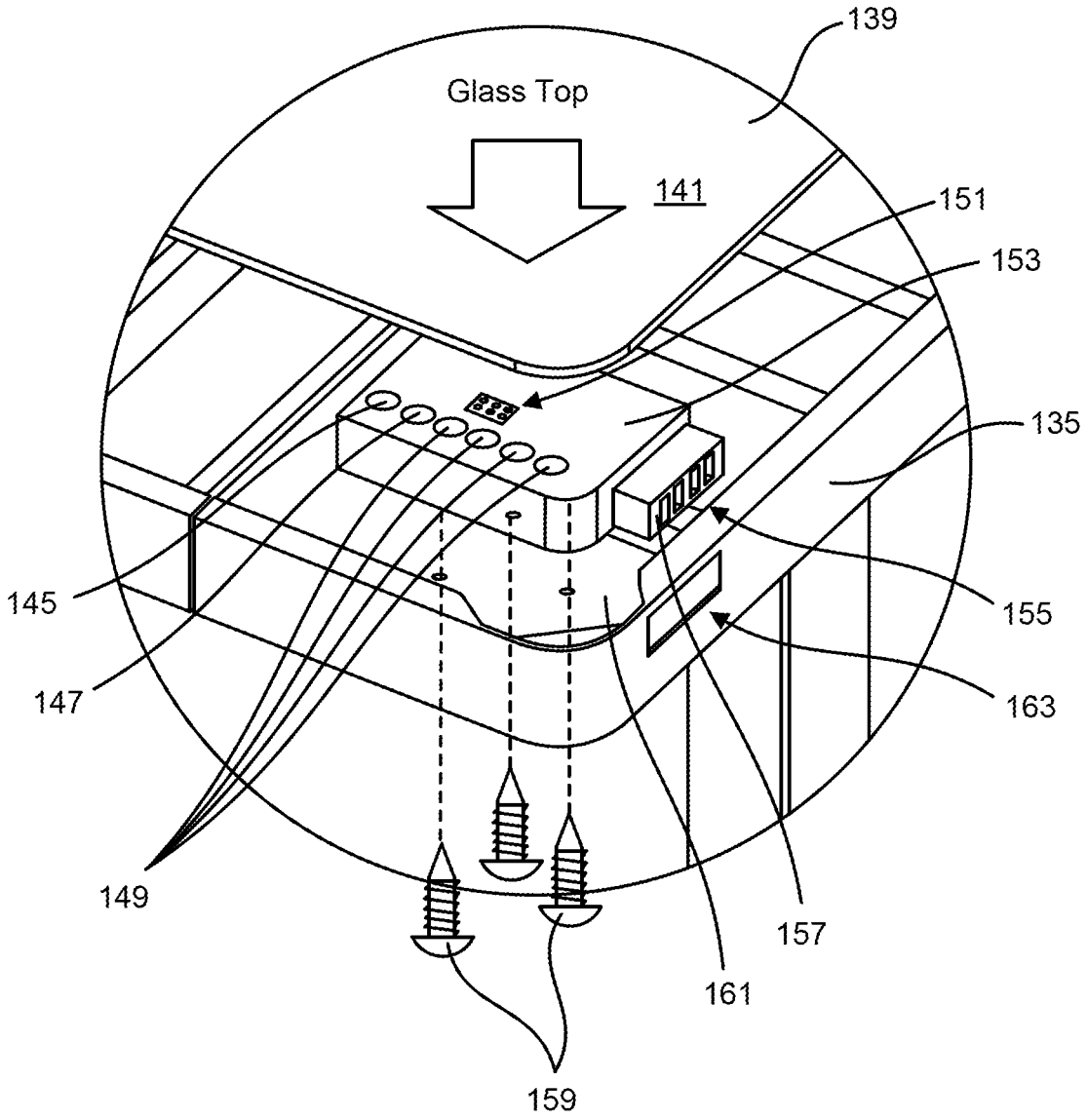
FIG. 8 is an enlarged, exploded perspective view of an interface module and associated components for use in embodiments of the present technology.

As shown in FIG. 8, the module 153 may be assembled within the table top assembly 103, underneath the glass top 139, and within the thickness provided by the apron 135 and framing structure. The module 153 may be attached (e.g., with screws 159) to a supporting plate 161 connected to the framing structure of the apron 135. The supporting plate 161 may be arranged such that, when the module 153 is attached to it, the top of the module 153 will abut the underside of the glass top 139, and the ports 155 and locking control 157 (which are desirably integrated components of the module 153) are positioned within an opening 163 along the side of the apron 135. As FIG. 6 also shows, the buttons 145, 147, 149 (which may or may not be illuminated) and the display 151 of the interface 143 may be positioned on the top of the module 153, such that they are viewable and activatable by the user through the glass top 139.

Figure 9:
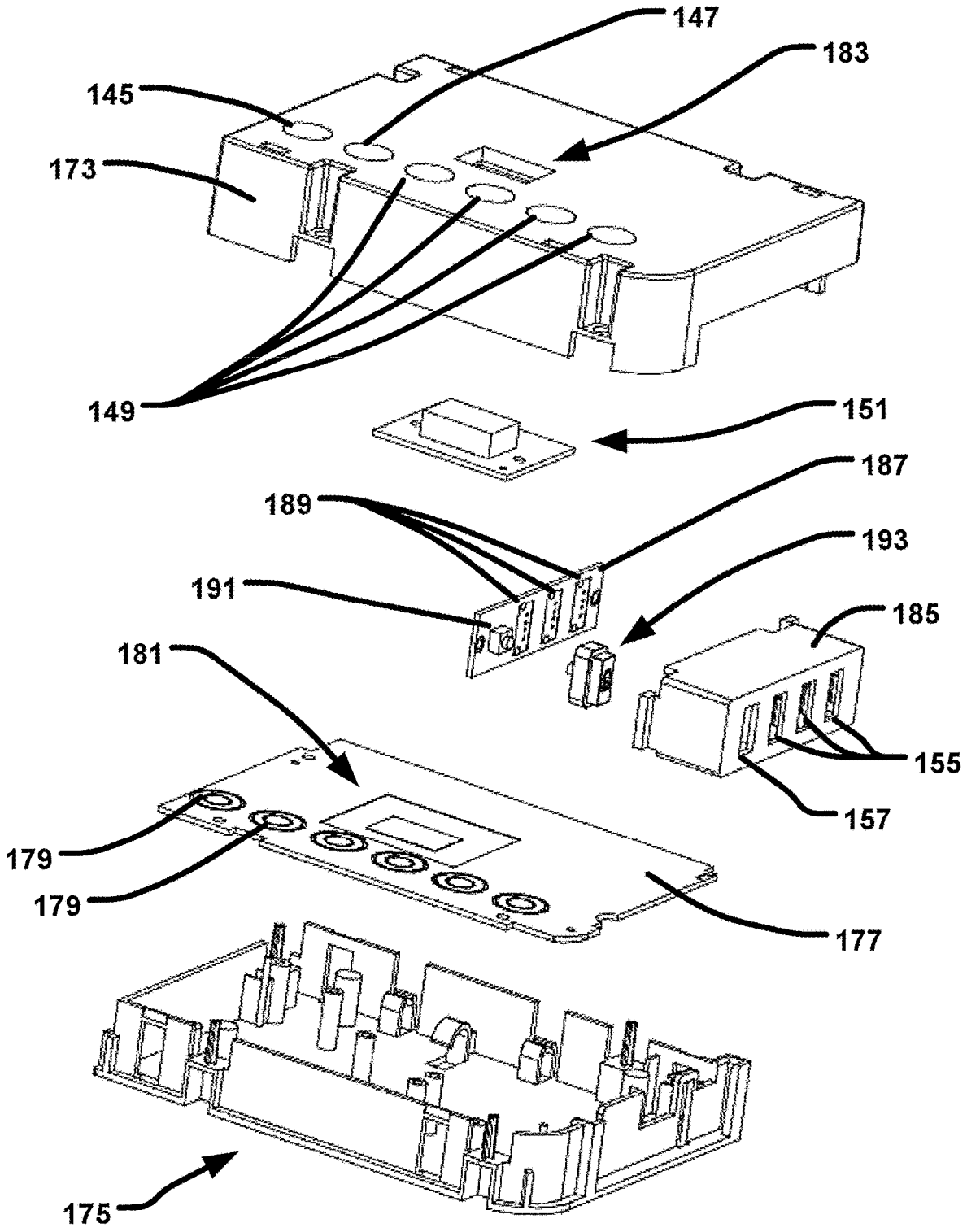
FIG. 9 is an exploded perspective view of the interface module of FIG. 8.
Figure 10:
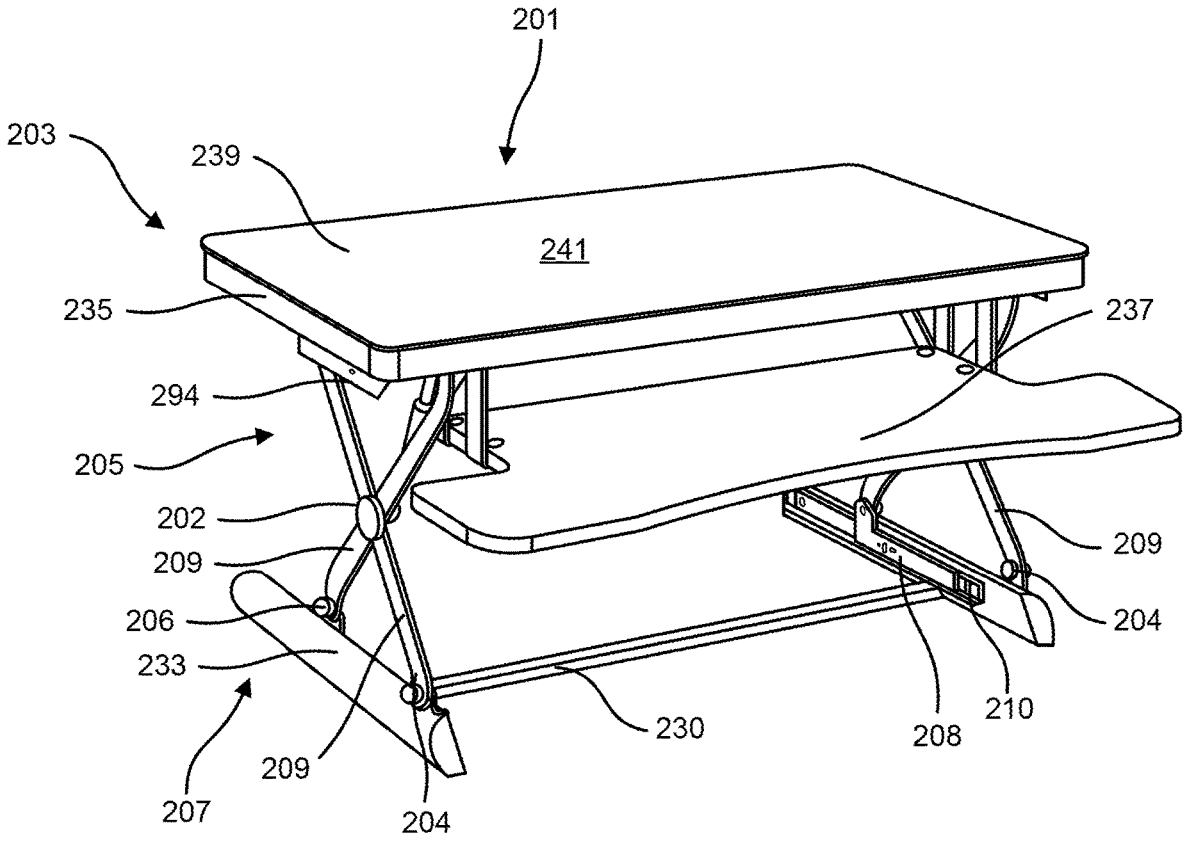
FIG. 10 is a perspective view of an adjustable height desktop platform in accordance with another embodiment of the present technology in an extended configuration.
Figure 11:
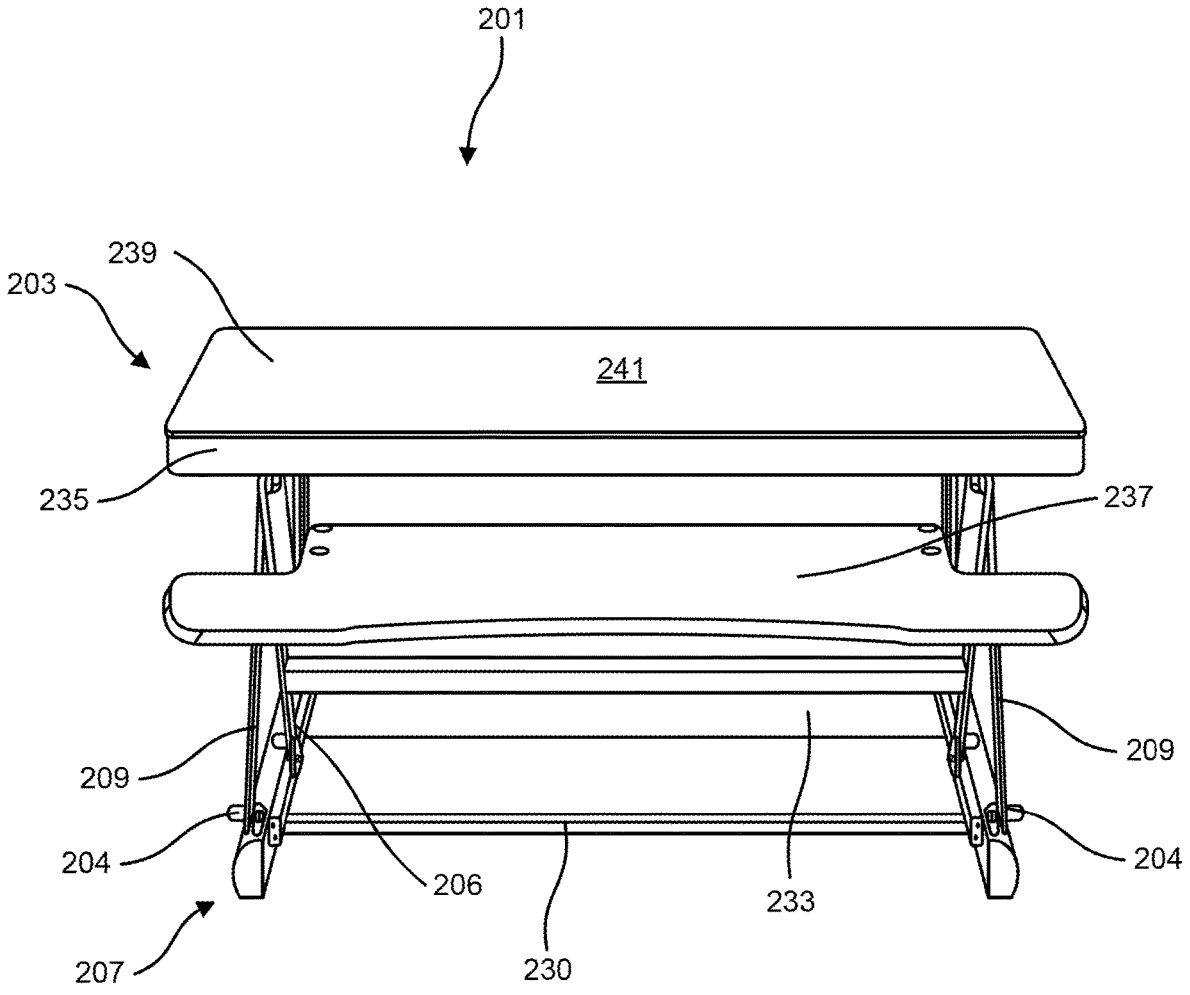
FIG. 11 is a front view of the embodiment of FIG. 10 in an extended configuration.
Figure 12:
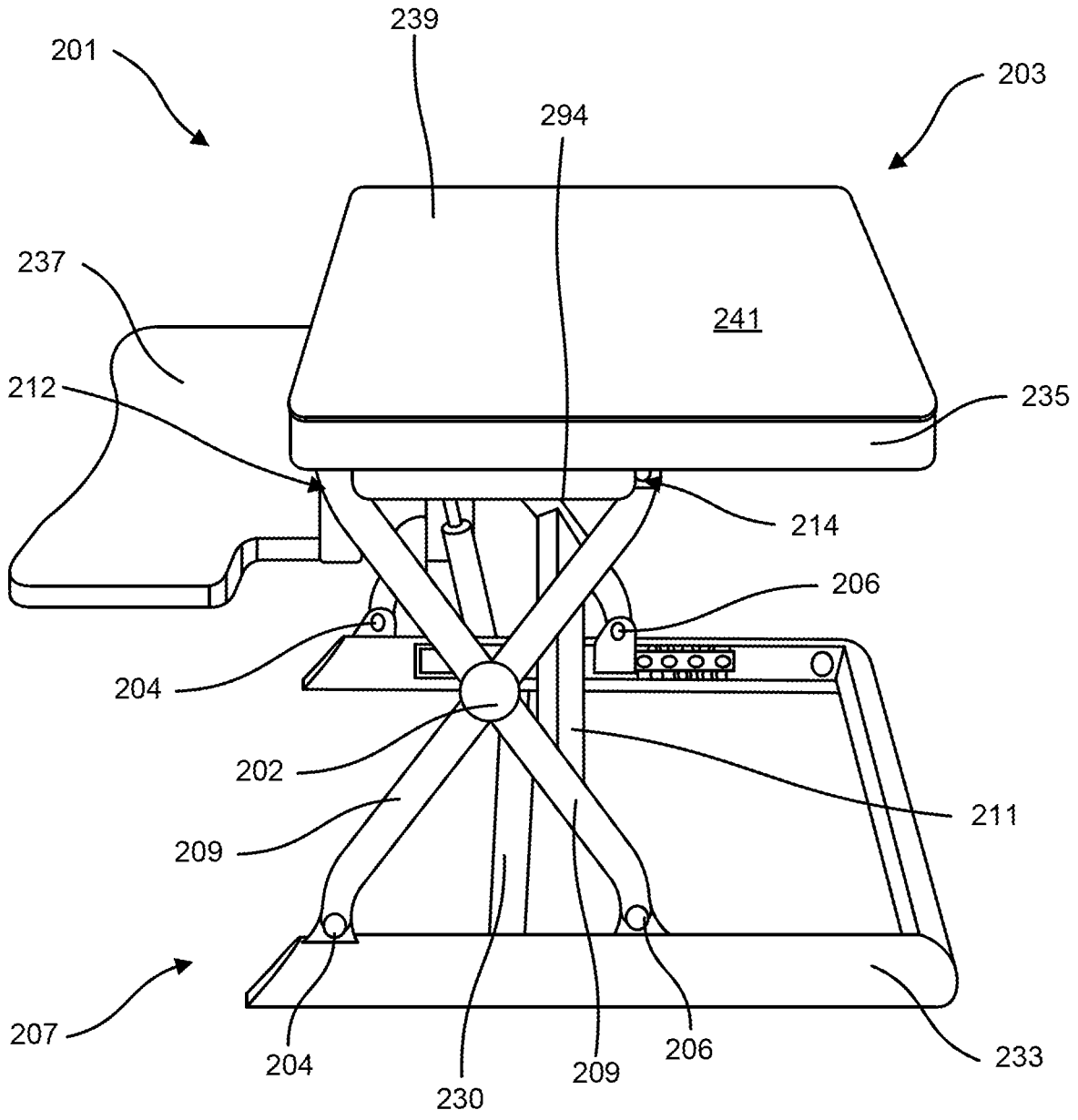
FIG. 12 is a side view of the embodiment of FIG. 10 in an extended configuration.
Figure 13:
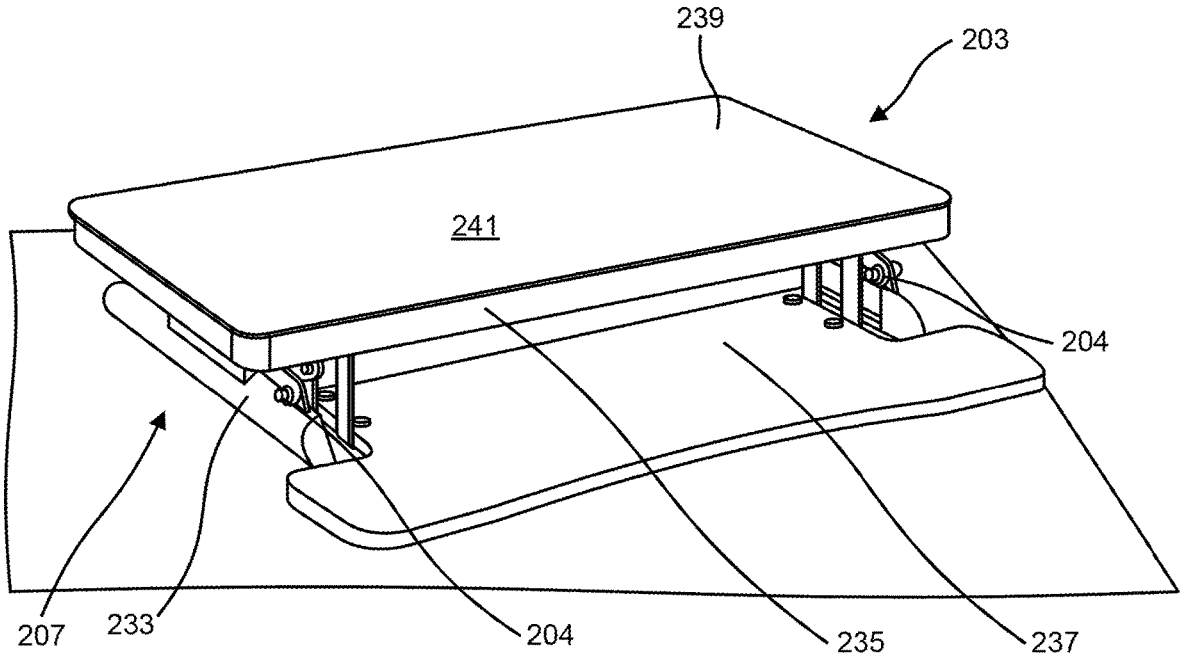
FIG. 13 is a perspective view of the embodiment of FIG. 10 in a collapsed configuration.
Figure 14:
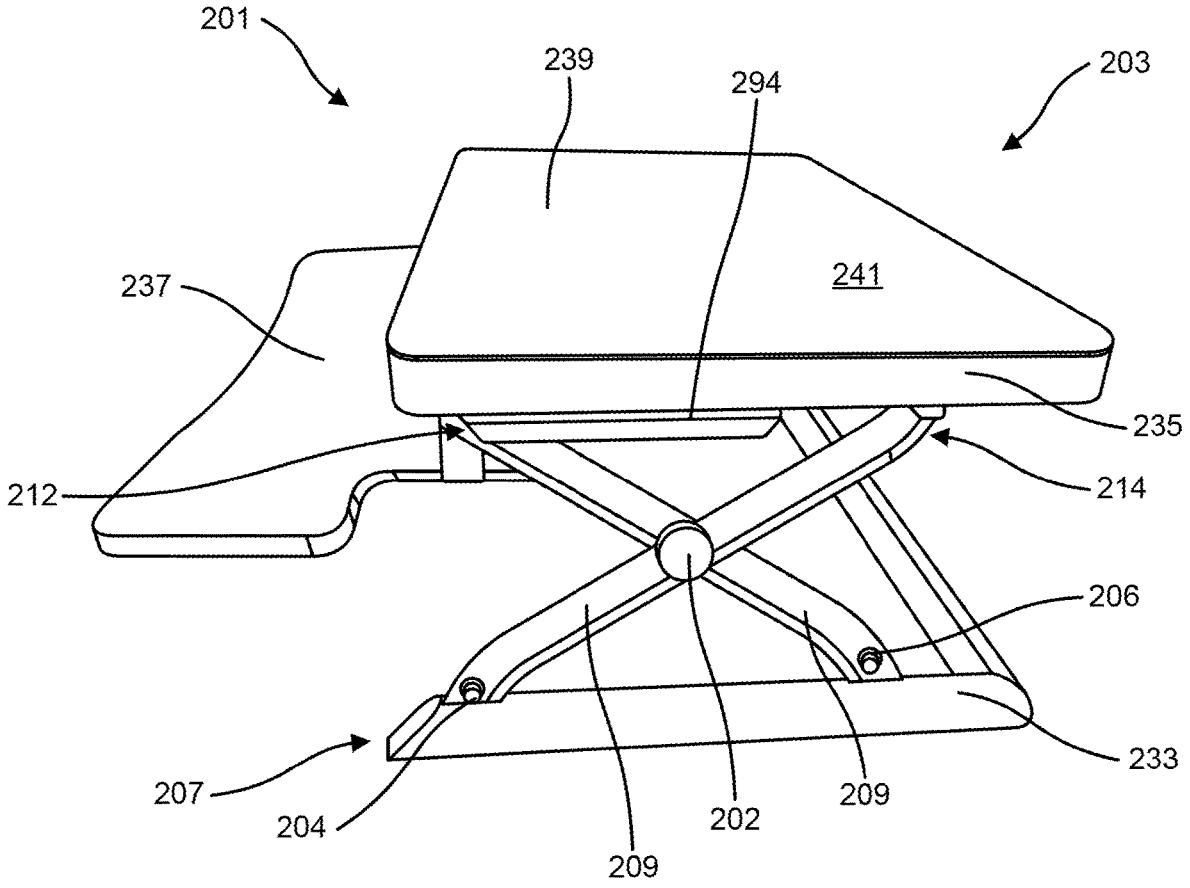
FIG. 14 is a side view of the embodiment of FIG. 10 in a partially extended configuration.

It should be noted that the module 153 shown in FIGS. 8 and 9 has a different configuration than that which would be used with the arrangement of buttons 145, 146, 147, 148 shown in FIG. 7, although both modules would operate in the same manner. That is, the module 153 of FIGS. 8 and 9 has up, down, and memory buttons 145, 147, 149, whereas the module (not shown) used in connection with FIG. 7 would have up, down, top, and bottom buttons 145, 146, 147, 148. Also, the ports 155 of the module 153 of FIGS. 8 and 9 are arranged slightly differently than the ports 155 of FIG. 7.

FIG. 9 illustrates an exploded view showing the subcomponents of the control module 153 of FIG. 8. As shown, the module 153 includes an outer housing comprising an upper housing portion 173 and a lower housing portion 175 connected together, which components may be formed (e.g., injection molded) out of plastic or any other appropriate material. Inside the outer housing is a horizontally arranged printed circuit board (PCB) 177 having sensor pads 179 for each of the capacitive buttons 145, 147, 149 as well as a connection 181 for the display 151, which is received within an opening 183 in the upper housing portion 173. The ports 155 as well as the locking control 157 may be arranged in an array defined by a molded plastic block 185 positioned at least partially within the outer housing of the module 153. A vertically arranged printed circuit board (PCB) 187 may be arranged behind and connected to the molded plastic block 185. Such PCB 187 may include connections 189 for each of the ports 155, as well as a momentary push button switch 191 depressible by an exposed push button 193 that forms part of the locking control 157.

The top surface 141 of the table top assembly 103 may also provide an interface for wirelessly (inductively) charging a smartphone, tablet, or other similar device. For example, another module designed to provide wireless charging through the glass top 139 of the table top assembly 103 may be assembled within the table top assembly, underneath the glass top, similarly to the module 153 discussed above.

Power to the various electrical components of the platform 101 may be supplied by a plug cable 171 for connection to a standard AC power outlet. The plug cable 171 may be connected to the table top assembly 103 through the apron 135 along the back of the platform, as shown in FIG. 6. The underside of the table top assembly 103 may thus include various electrical connections connecting some or all of the electrical components and communicating with the plug cable 171. Electrical power to the motor 119 may also be provided through a cable 169 extending down to the motor 119 from the table top assembly 103. In order to accommodate the differing distances between the table top assembly 103 and the motor 119 due to the height adjustability of the platform 101, the cable 169 may be designed to stretch, such as by having a coiled structure as shown in FIG. 6. In an alternative embodiment (not shown), the cable 169 may be incorporated into a retractable cord reel in order to similarly accommodate differing heights of the table top assembly 103.

The motor 119 that powers the piston 118 may be, for example, powered by a 60 W supply, which may be provided and controlled by the module 153. That available power could then be used to power various other devices when the motor 119 is not running. For example, the ports 155, which may be 2 amp USB charging ports, may draw on the same power supply used to supply power to the motor 119. That same power supply could also be used for many other devices, which may be connected to and even controlled by the module 153, such as lights, speakers, a heating and/or cooling function of a desk component like a cupholder, wireless (inductive) charging, etc. The module 153 can thus be programmed to cut off the power supply to those other devices when the motor is running, such that the available power is only supplied to the motor during its operation, and then the power can be returned to those other devices when the motor stops. In that way, those ancillary devices can share the single power source used to power the motor, which may beneficially allow the adjustable height desktop platform to include those other electrically powered features at lower cost (i.e., without the need for separate drivers for each of the different components). Moreover, as the motor 119 for adjustment of the height of the platform is likely to be used relatively infrequently (at least compared to the usage of those other ancillary devices), the temporary interruption of the power supply to at least some of those devices during motor operation is not likely to be a significant inconvenience to the user.

It should be noted that other mechanical height adjustment assemblies for driving the height adjustment of the platform 101 may be provided instead of the pneumatic piston 118. As one example, the motor 119 may instead drive the rotation of a long, externally-threaded screw received within an internally-threaded sleeve, so as to telescopically drive the sleeve away from the screw to extend the mechanical height adjustment assembly and drive the table top assembly 103 upwardly.

An alternative embodiment of an adjustable height desktop platform 201 is illustrated in FIGS. 10-18. Unless otherwise noted, the components of the embodiment of FIGS. 10-18 are similar to those of the embodiment of FIGS. 2-7. Moreover, reference numerals in FIGS. 10-18 similar to those in FIGS. 2-7 (i.e., increased by 100) are used to refer to analogous elements, and therefore such analogous elements may not be separately discussed below in connection with the embodiment of FIGS. 10-18. The principal difference between the embodiment of the platform 201 in FIGS. 10-18 and the embodiment of the platform 101 in FIGS. 2-7 is that the height adjustment of the platform 201 in FIGS. 10-18 is performed manually rather than via an electrically powered and controlled motor 119, as discussed below.

Figure 17:
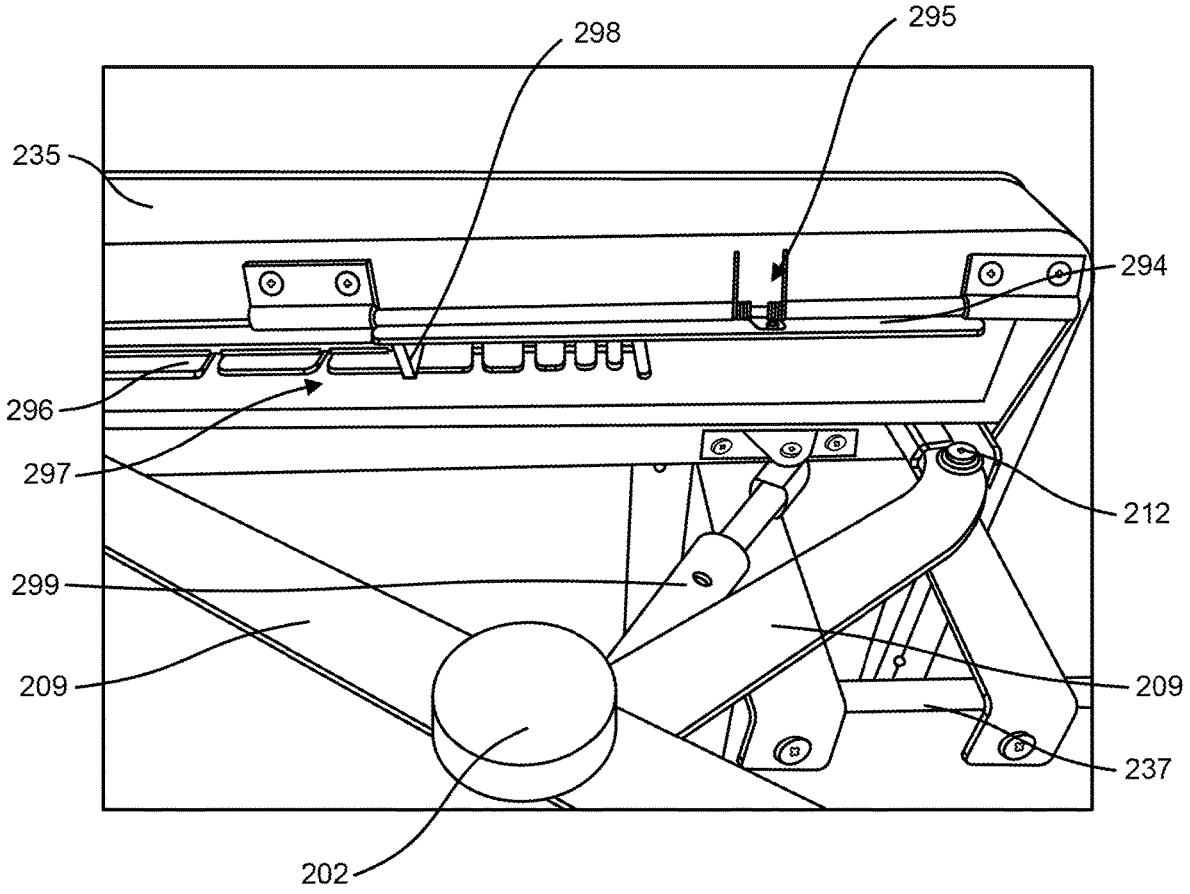
FIG. 17 is a different perspective view of the locking components shown in FIG. 16.
Figure 18:
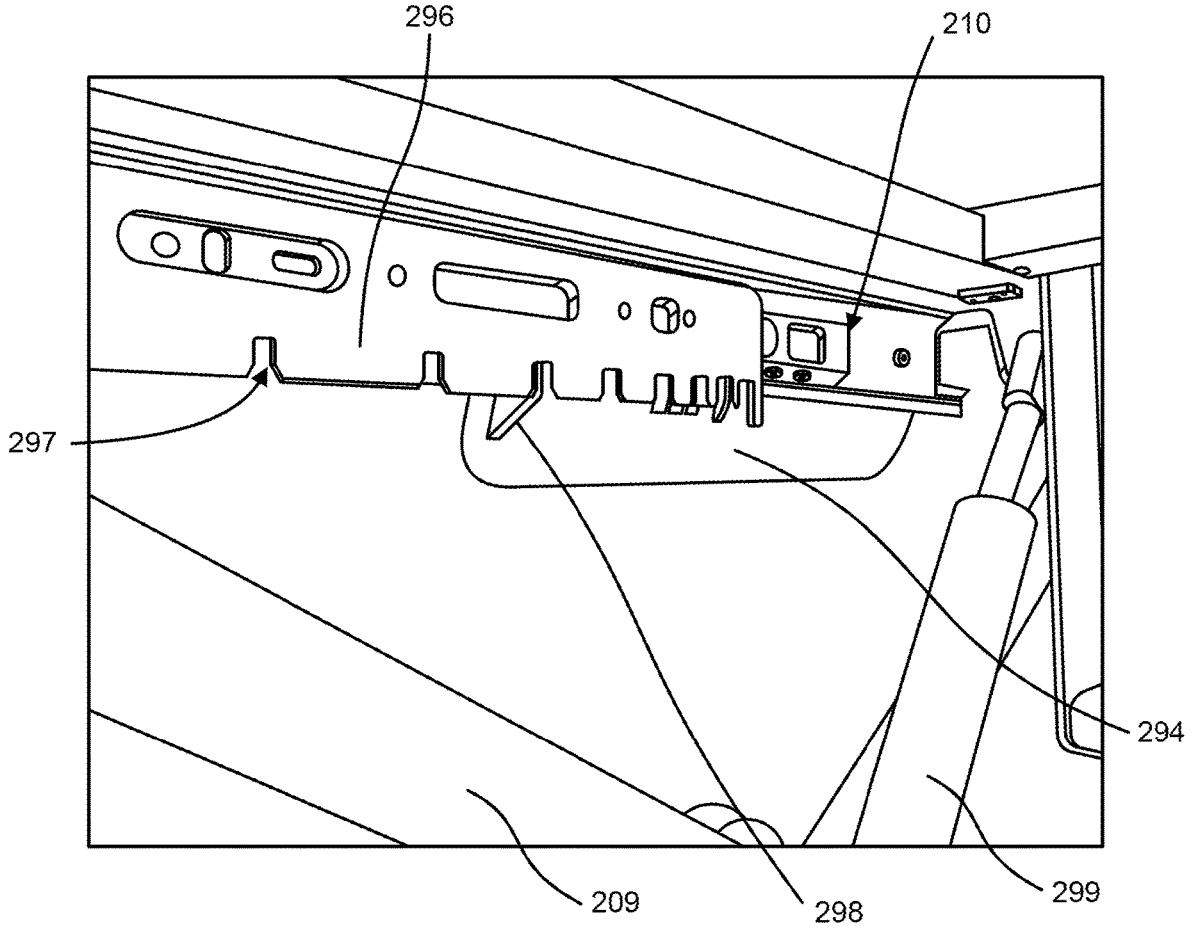
FIG. 18 is another perspective view of the locking components shown in FIG. 16.

As shown in FIGS. 10-18, the structure and function of the table top assembly 203, the leg assembly 205, and the base 207 of the platform 201 are largely the same as the corresponding components of the platform 101 in FIGS. 2-7. However, since the platform 201 does not include an electrically powered system to adjust the height, various components may be provided to allow the user to manually adjust the height of the table top assembly 203. For example, the platform 201 may include a system that is actuatable by the user in order to lock and unlock the height adjustability of the platform. In one such embodiment, a lever 294 may be provided on the underside of the table top assembly 203 along either or both sides. The lever 294 may be designed such that the height adjustability of the platform 201 is unlocked when the lever 294 is lifted upwards by the user. The height adjustability may then be re-locked when the lever 294 is released. In that regard, a spring, such as torsion spring 295, may be provided to bias the lever 294 into a locked position. As shown in FIGS. 17 and 18, a locking plate 296 having one or more notches 297 to define discrete locking positions may be included on the underside of the table top assembly 203. For example, the locking plate 296 may be attached to the rail 208 that is pivotably connected to the upper rear end 214 of at least one of the linkages 209, as discussed above. In that way, the locking plate 296 translates forwards and backwards (along with the upper rail 208) when the height of the table top assembly 203 is adjusted. The desired height can then be selected and locked via at least one tab 298 connected to the lever 294, which tab 298 fits within one of the notches 297 when the lever 294 is released, as shown in FIG. 18.

Figure 15:
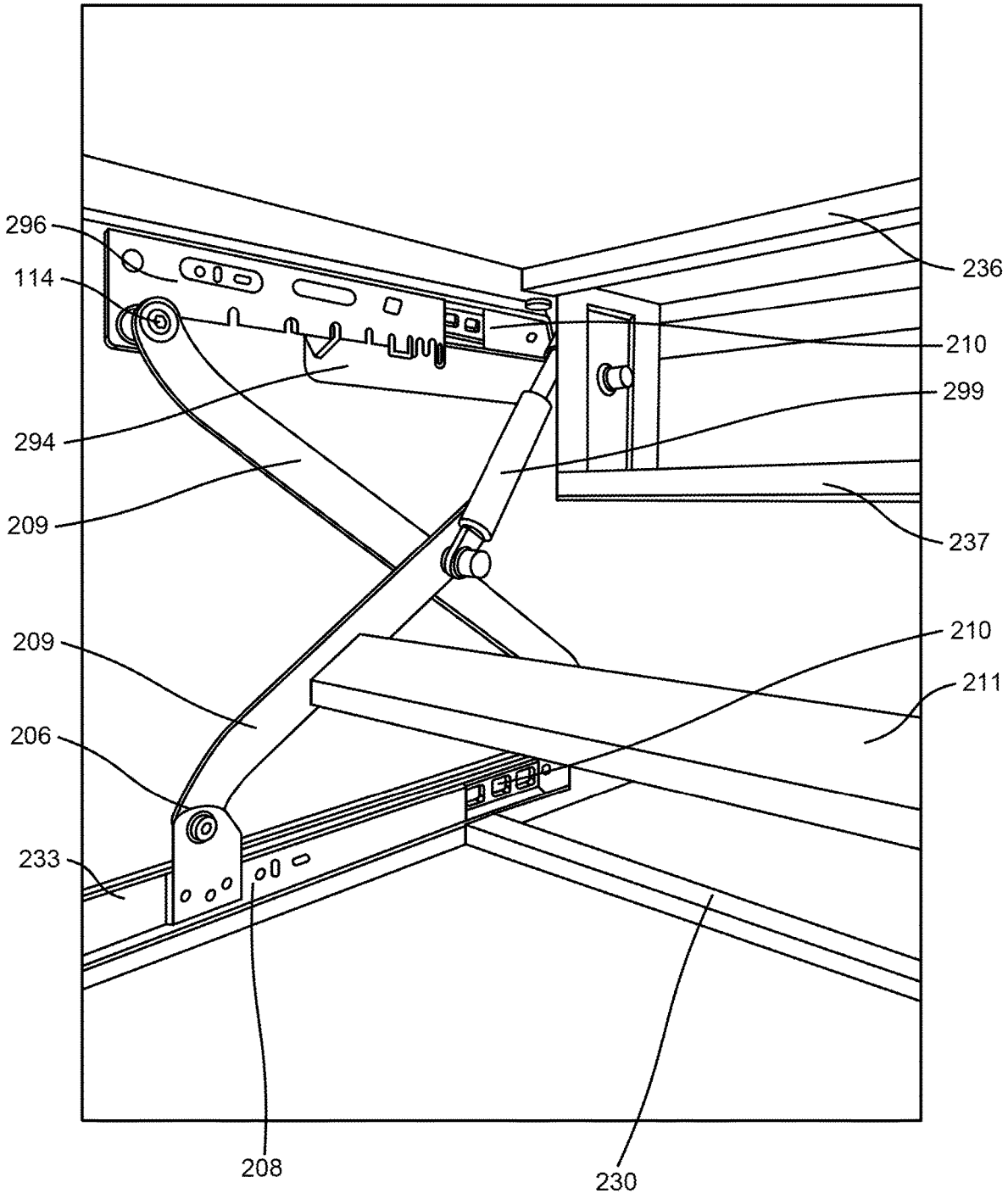
FIG. 15 is a perspective view of a portion of the underside of the embodiment of FIG. 10 in a partially extended configuration.
Figure 16:
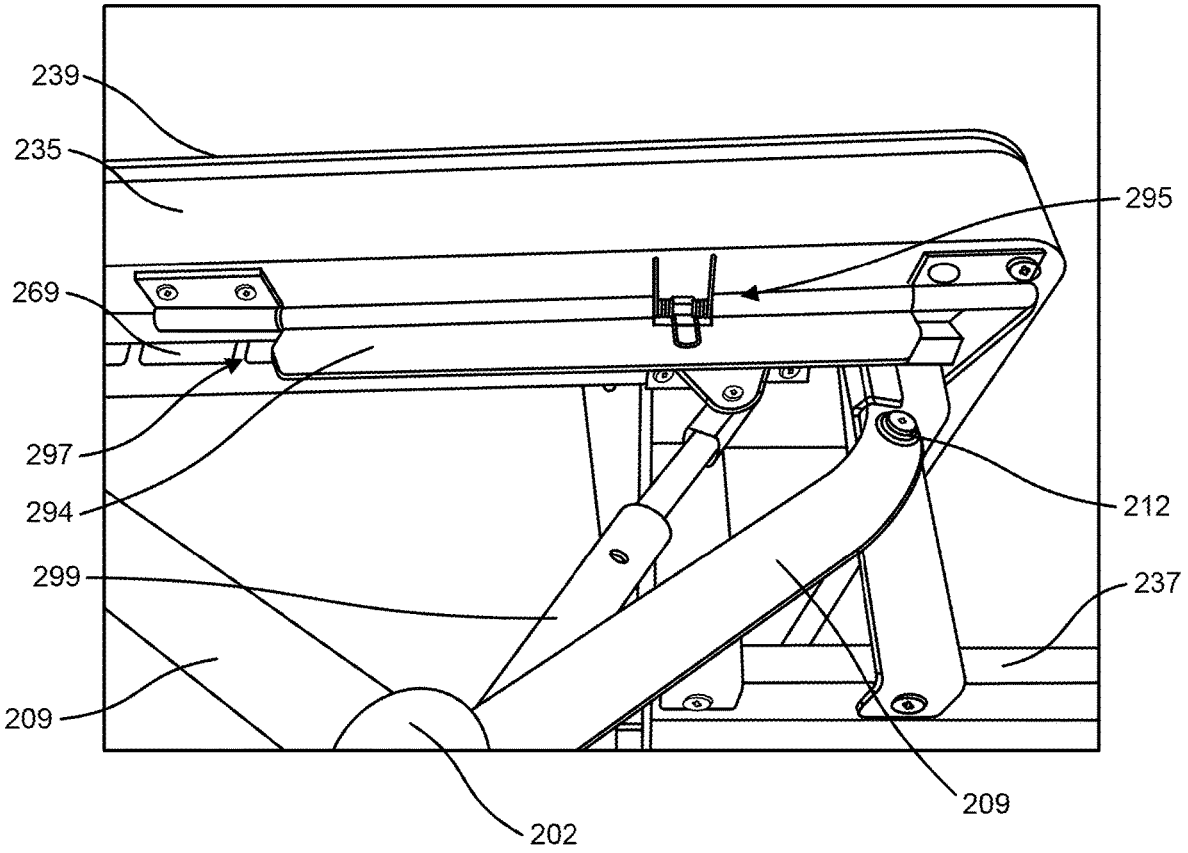
FIG. 16 is an enlarged perspective view of a portion of the embodiment of FIG. 10, focusing on the locking components.

In order to assist the user in the manual adjustment of the height of the table top assembly 203, other components may be provided in the platform 201 of FIGS. 10-18. For example, as shown in FIG. 15, one or more springs 299, such as gas springs, may be provided (e.g., between the table top assembly 203 and the linkages 109). Such springs 299 may be configured so as to apply a biasing force tending to raise the height of the table top assembly 203. In that way, the weight of the devices supported by the table top assembly 203 (as well as the weight of the table top assembly itself) may be at least partially offset, so that it is easier for the user to manually raise the height of the table top assembly 203 when unlocked. In alternative embodiments, the spring 299 may be a locking gas spring that is connected to the levers 294 so as to be unlocked when the levers 294 are actuated. In other alternative embodiments, the spring(s) 299 may be replaced by or supplemented by gas dampers to smooth and/or slow the extension and collapsing movement of the platform 201.

Even though not shown in the manual version of the platform 201 illustrated in FIGS. 10-18, that embodiment may include one or more electrical components other than an electrically powered motor to adjust the height of the table top 203. For example, any of the other electrical components discussed above in connection with FIGS. 2-9, such as lights, speakers, USB charging ports, a heating and/or cooling function of a desk component like a cup-holder, inductive charging, etc., may be included in the manual version of the platform 201.

Figure 19:
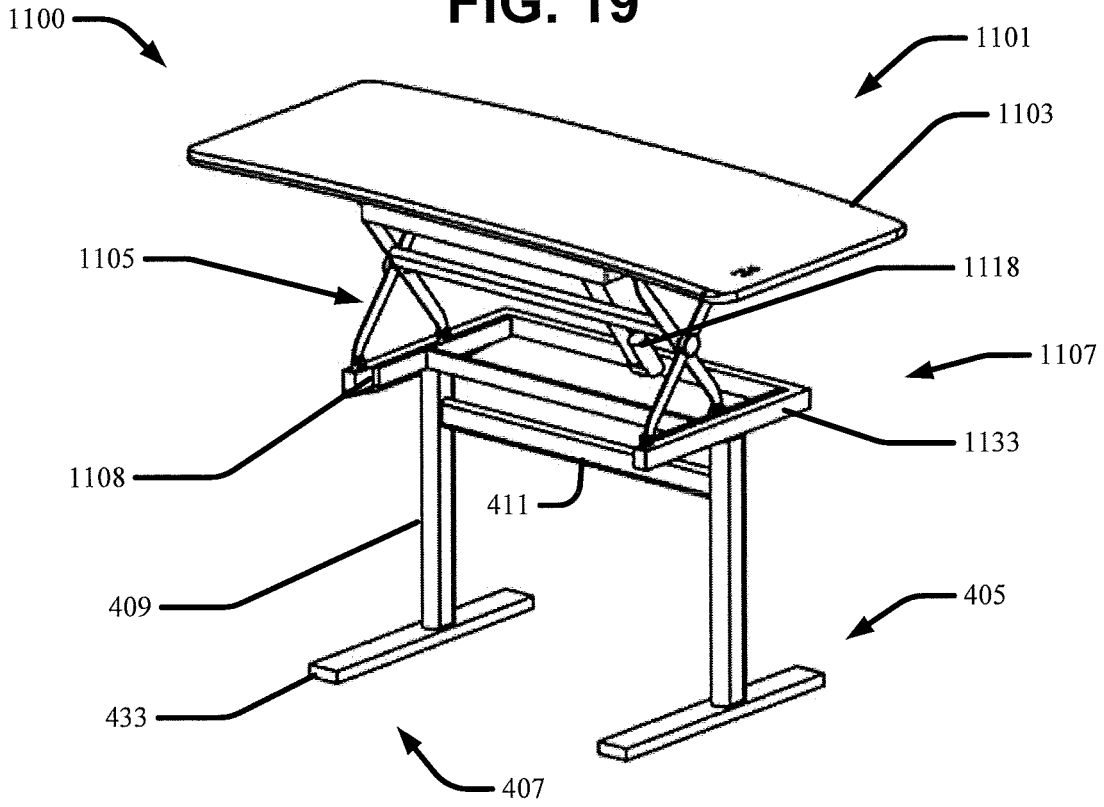
FIG. 19 is a perspective view of an adjustable height desktop platform attached or integrated to an exemplary freestanding leg assembly in accordance with one embodiment in an extended configuration.
Figure 20:
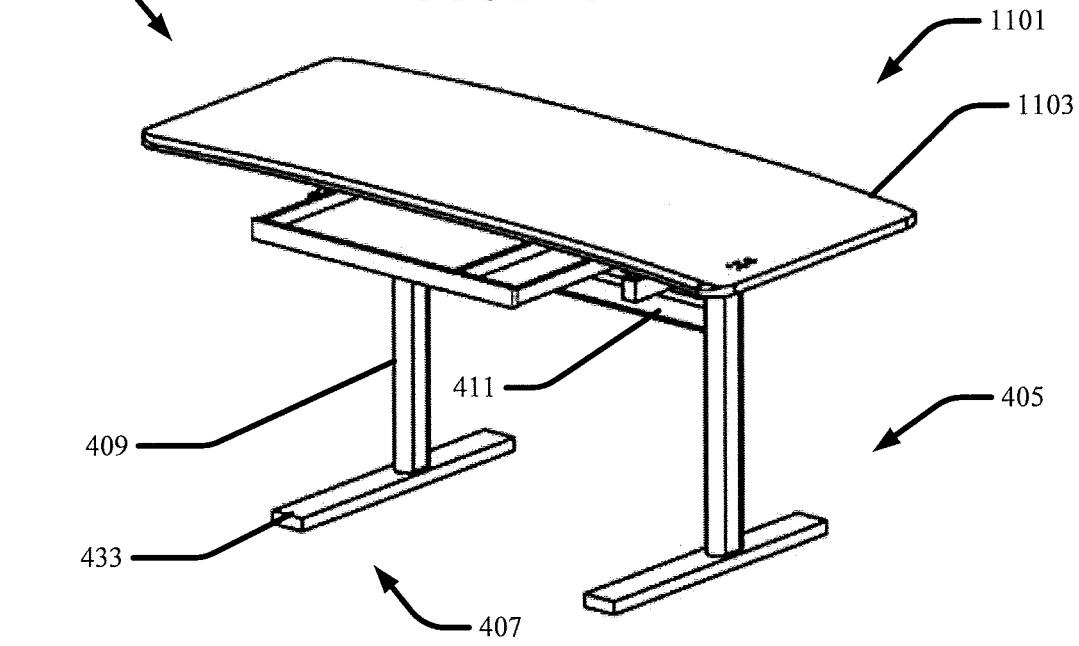
FIG. 20 is a perspective view of the embodiment of FIG. 19 in a collapsed configuration.

Referring to FIGS. 19-20, the adjustable height desktop platform 1101 may be attached to the freestanding leg assembly 405. The freestanding leg assembly 405 may be an integrated assembly including a plurality of vertical legs 409 extending between the table top assembly 1103 and the base 407, as well as one or more horizontal cross bars 411. The horizontal cross bar(s) 411 may be integrally connected to the plurality of vertical legs 409 to form a monolithic component. The upper ends of the vertical legs 409 may be connected to a platform base 1107 of the adjustable height desktop platform 1101. Any number and position of the plurality of vertical legs 409 may be contemplated by this disclosure. In one embodiment, the platform base 1107 of the platform 1101 may be implemented as an upper frame which is integrated with the freestanding leg assembly 405 so that the crisscrossing linkages 1105 of the desktop platform are removable from the upper frame of the leg assembly 1101.

The base 407 may include feet 433 connectable to the lower ends of the respective legs 409. The feet 433 may also include wheels (not shown) to facilitate movement of the desk system 1100, and such wheels may be lockable to better secure the desk system 1100 when it would be desirable to maintain the desk in a completely stationary position. The locks for the wheels may be mechanically operated by the user, or they may be electronically controlled.

The crisscrossing linkages 1105 may also include hall-effect sensors that act as proximity sensors to identify when the crisscrossing linkages 1105 are near full extension and/or near full contraction, so as to send a signal to the control module 153 (discussed above) to stop further movement of the motor 119 in the expansion and/or contraction direction.

Through use or operation of the pneumatic linear piston 1118, which is connected to the frame structure 1133 of the platform base 1107, and through use of the rail 1108, which is pivotably connected to the lower rear end of at least one of the crisscrossing linkages 1105 and which is also slidably connected to a lower front end of at least one of the crisscrossing linkages 1105, as shown in FIG. 19, manufacturing of an adjustable height desk system 1100 including the adjustable height desktop platform 1101 and the freestanding leg assembly 405 may advantageously be accomplished with significantly less noise and vibration than typical and conventional manufacturing of a freestanding desk using a shaft and vise.

The height adjustment of the table top assembly 1103 may be driven by a mechanical height adjustment assembly that may be electrically powered and controlled. For example, the height adjustment assembly may include a pneumatic linear piston 1118 powered by a motor 1119. The lower end 1120 of the piston 1118 may be pivotably connected to the frame structure 133 of the platform base 1107, as shown in FIG. 19, and the upper end 1122 of the piston 1118 may be pivotably connected to the table top assembly 1103. In that way, the piston 1118 can pivot with respect to both the base 1107 and the table top assembly 1103 as the piston 1118 extends and retracts to drive the height adjustment of the platform 1101.

In one embodiment, the base 407 of the present disclosure constructed without decoratively encasing an inner tube moving legs advantageously allows a manufacturer to implement the adjustable height desk system 1100 with significantly less restrictions in design and higher efficiency than existing techniques and practices. For example, in one embodiment the fully or partially enclosed frame structure 133 of FIG. 2 is not required when a track and rail assembly is built into the upper portion of the freestanding leg assembly 405. The platform base 1107 may be manufactured as an integral component of the freestanding leg assembly 405 or it may be manufactured as a base for the adjustable height desktop platform 1101 which is then fixable to the legs 409 of the freestanding leg assembly 405. In another embodiment, the adjustable height desk system 1100 of the present technology may advantageously allow less financial burdens for the manufacturer and cost savings.

The adjustable height desk system 1100 may be adjustable so as to vary the height of the table top assembly 1103 from the platform base 1107, and in turn the top surface of the furniture on which the platform base 1107 is positioned. For example, the platform 1101 may be adjustable between a collapsed configuration, as shown in FIGS. 20 and 22, and a fully extended configuration, as shown in FIGS. 19 and 21, as well as any number of intermediate positions.

In the embodiments disclosed in FIGS. 19-20, the adjustable height desktop platform 1101 may be securely attached to the freestanding leg assembly 405. By way of a non-limiting example, corresponding bolt and nut fasteners may be capable of engaging portions of the adjustable height desktop platform 1101 to securely attach to the freestanding leg assembly 405. It should be understood, however, that any appropriate fastening device may be used, not just that shown and described herein. Other various configurations may also be contemplated.

Figure 21:
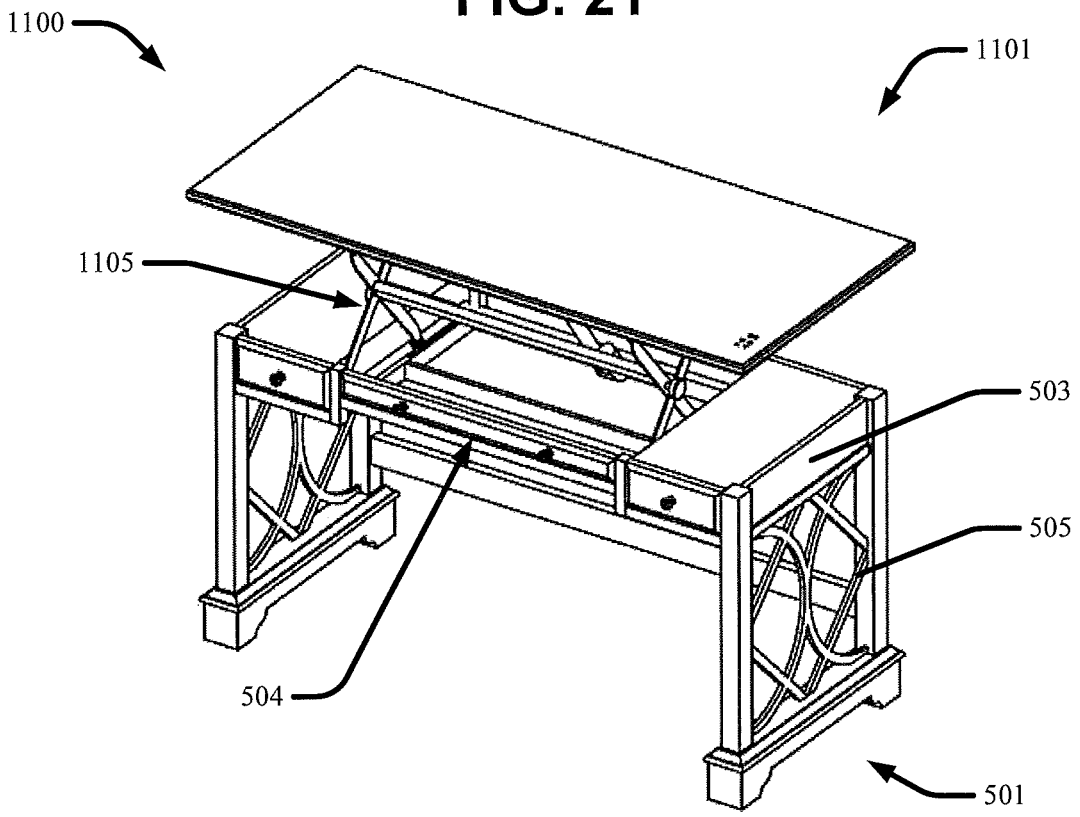
FIG. 21 is a perspective view of an adjustable height desktop platform attached or integrated to a desk assembly in an extended configuration.
Figure 22:
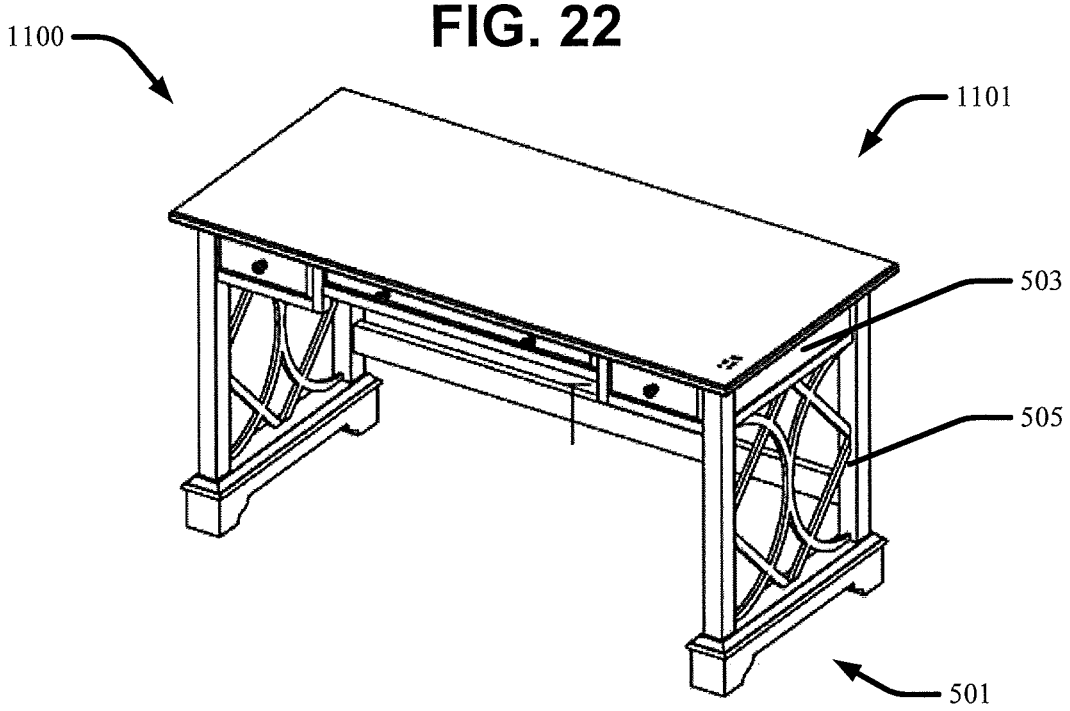
FIG. 22 is a perspective view of the embodiment of FIG. 21 in a collapsed configuration.

In other embodiments disclosed in FIGS. 21-22, the adjustable height desktop platform 1101 may also be securely attached to a desk assembly 501. The desk assembly 501 may include an upper structure 503 and a plurality of support structures 505. The upper structure 503 may be mounted on top of the plurality of support structures 505. The upper structure may include a compartment 504 that is open at a top portion. The adjustable height desktop platform 1101 may be an integrated assembly extending between the table top assembly 1103 and a bottom section of the compartment 504.

In some embodiments, the adjustable height desktop platform 1101 may be operatively attached to the desk assembly 501. The operative attachment of the platform base 1105 to the desk assembly 501 may provide the tactile feedback to ensure that the desktop platform 1101 has been secured to the desk assembly 501 in the desired position. The tactile feedback may be audible in the form of a click or snap sound as well as providing a subtle click or snap that may be felt by the user as the desktop platform 1101 is secured to the desk assembly 501.

Although as discussed up to this point, the adjustable height desktop platforms disclosed herein may be designed to be positioned on the top surface of a piece of furniture (e.g., a desk or table), such that a user can use the platforms as an adjustable height or "standing"-type desk, the structure of the height adjustment (e.g., including crisscrossing linkages or telescoping legs) can alternatively be used on adjustable height desks themselves as the mechanism for adjusting the height of the desk.

Figure 23:
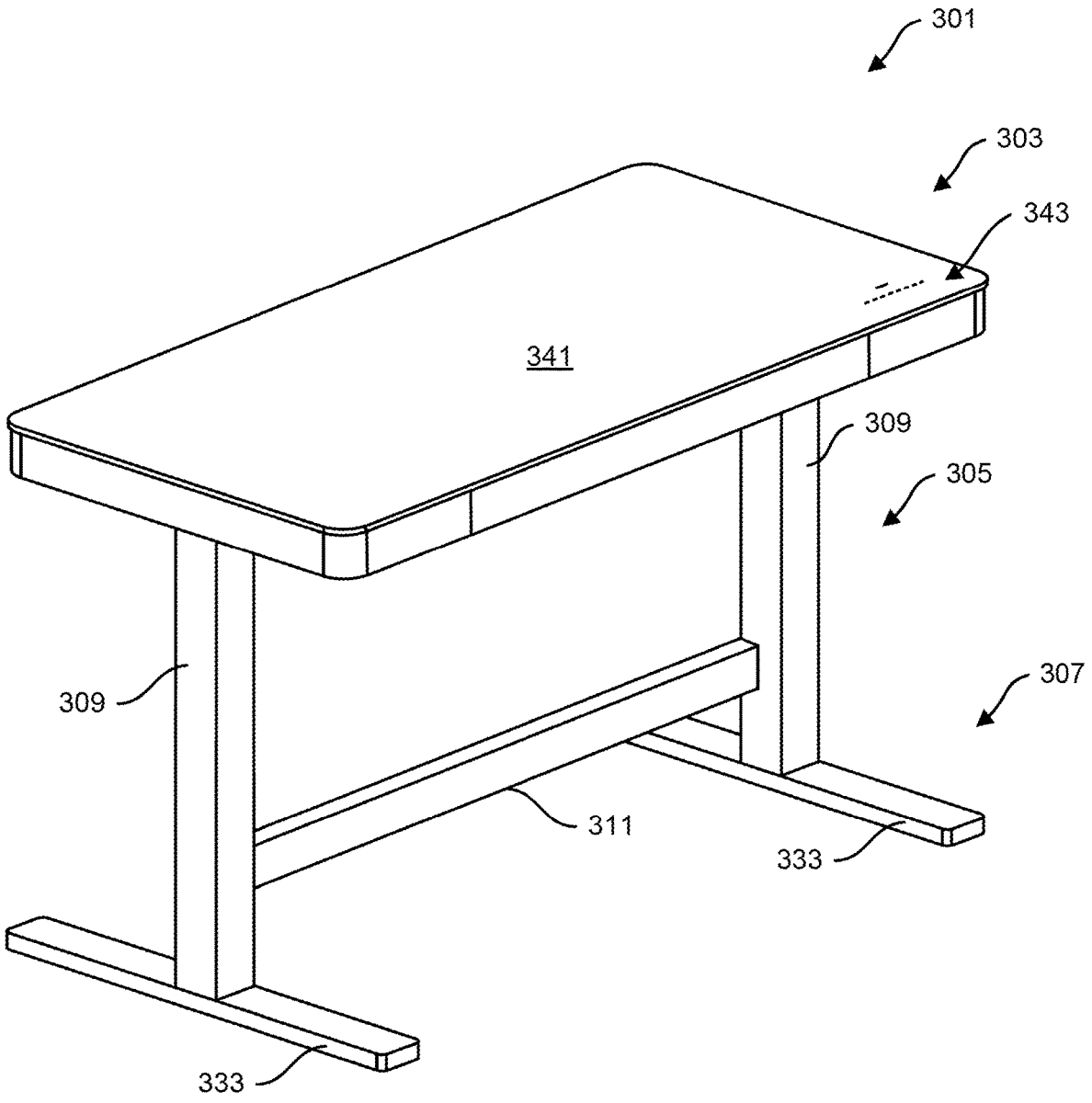
FIG. 23 is a perspective view of an adjustable height desk in accordance with an embodiment of the present technology.
Figure 24:
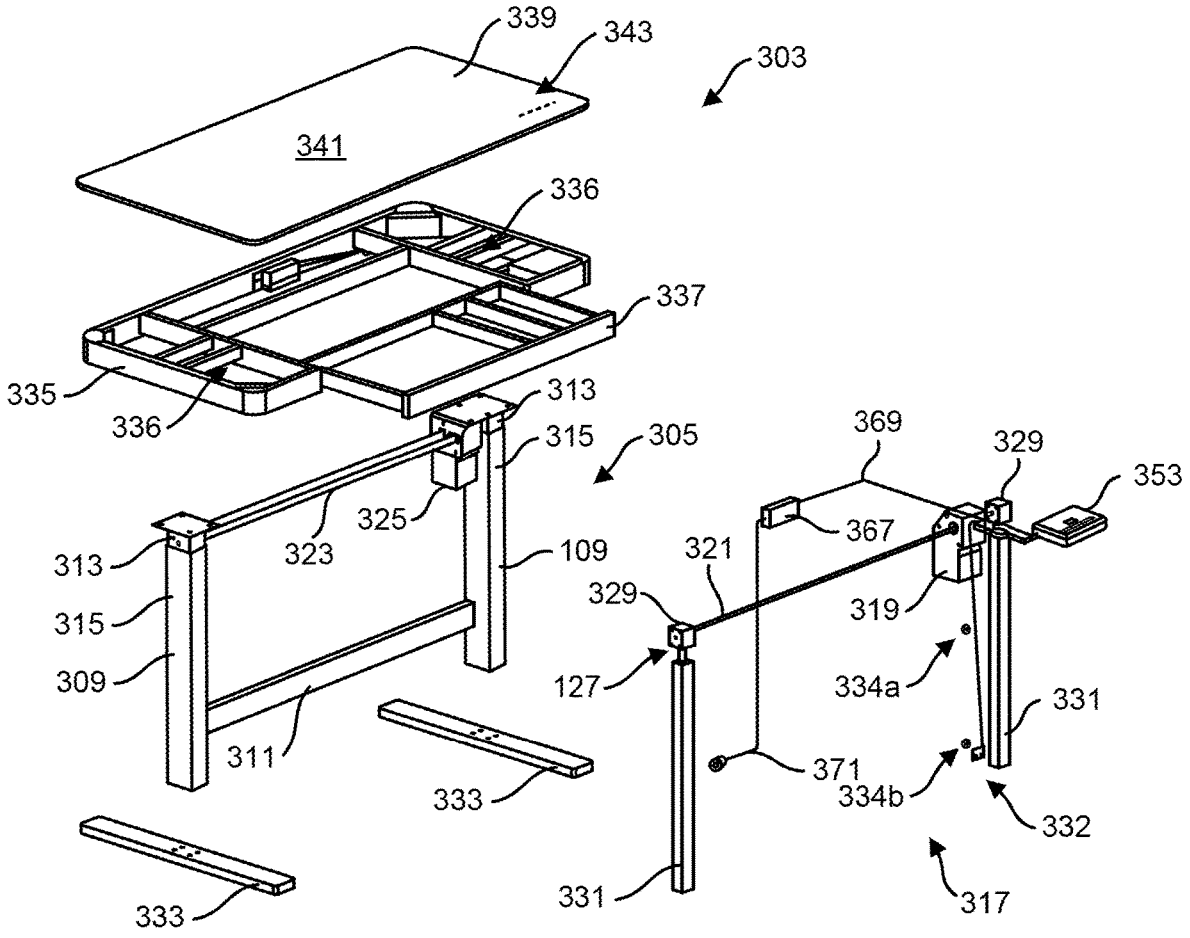
FIG. 24 is an exploded perspective view of the adjustable height desk of FIG. 23.
Figure 25:
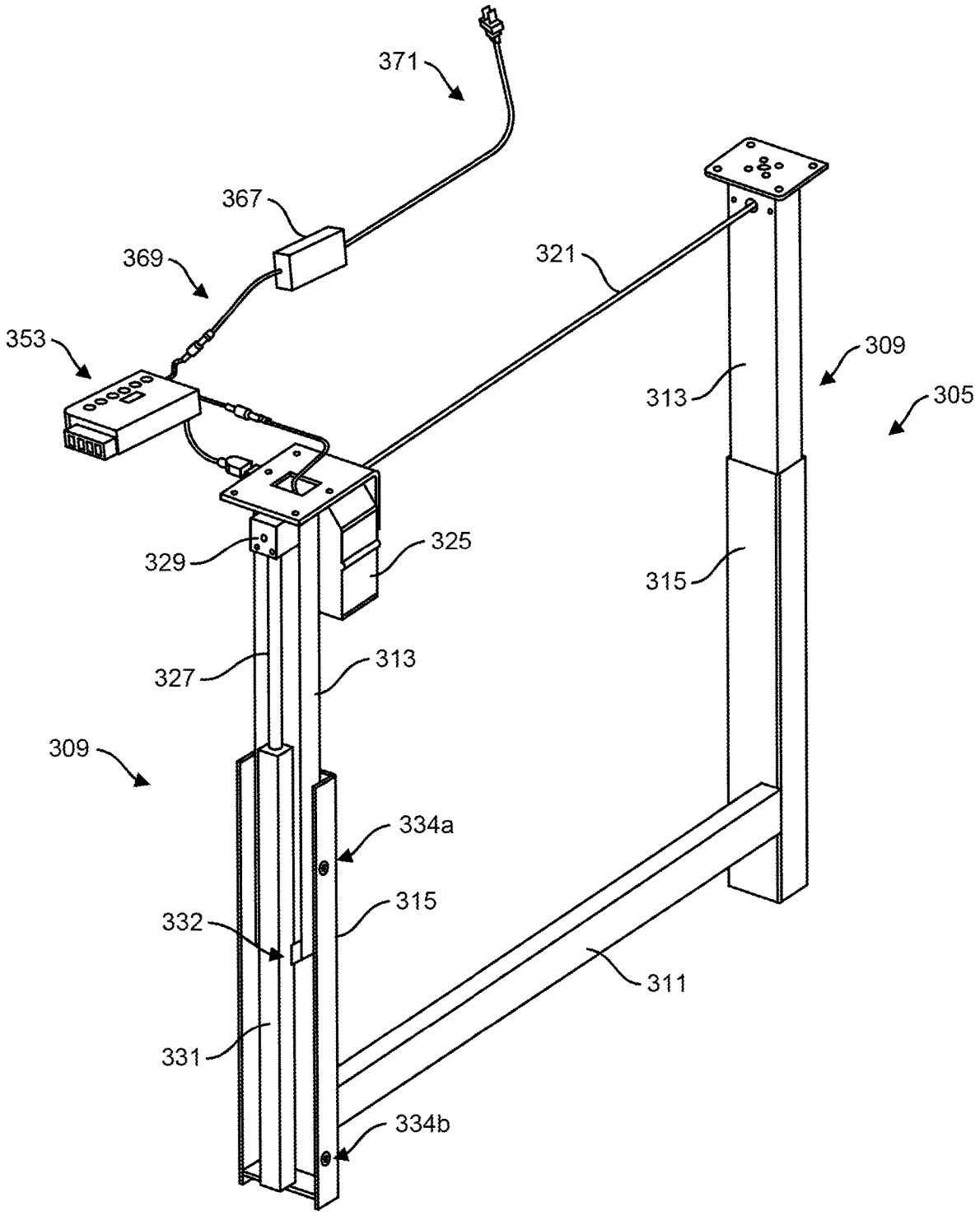
FIG. 25 is a perspective, partial sectional view of a leg assembly, showing the internal arrangement of some of its subcomponents.
Figure 26:
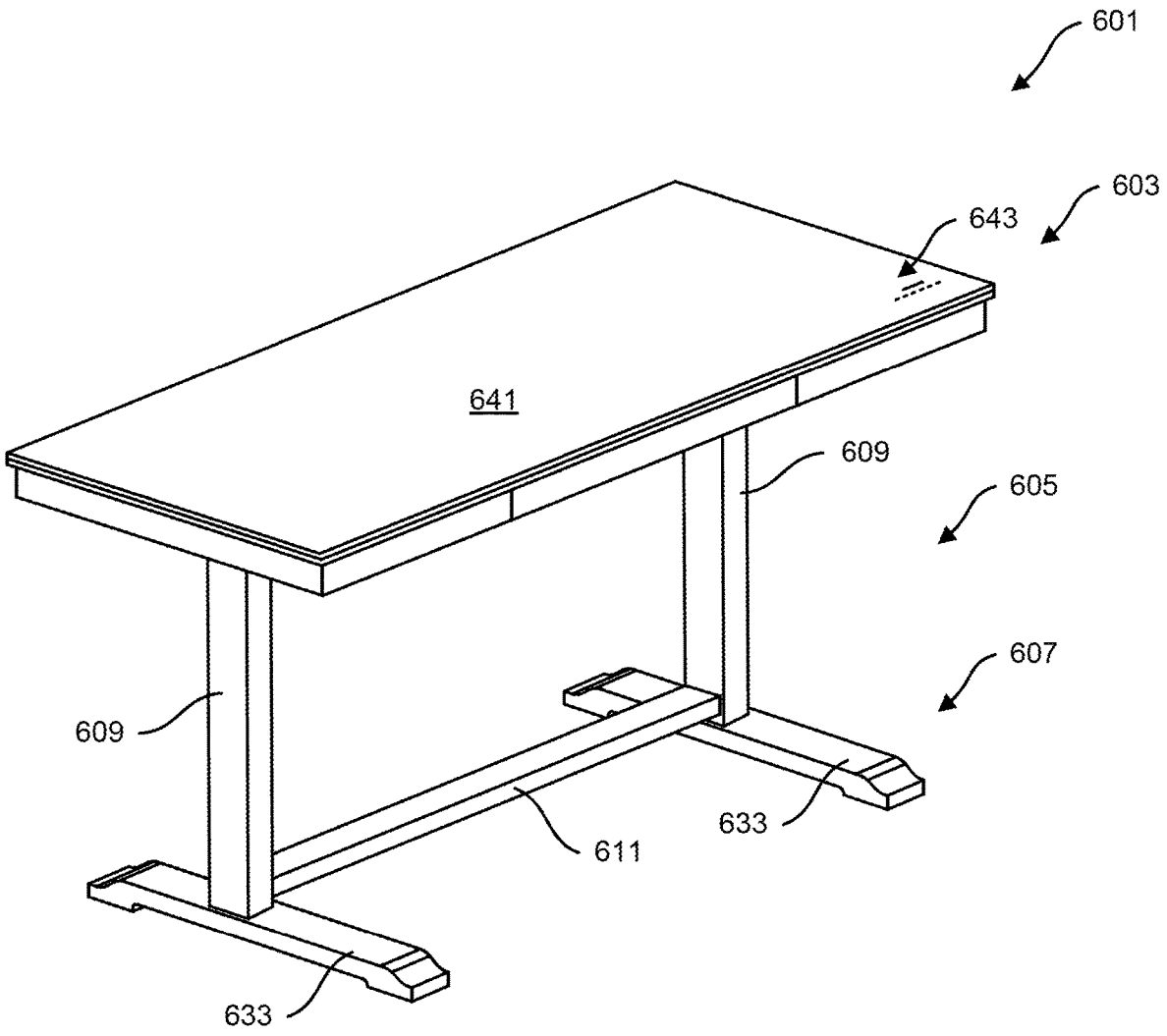
FIG. 26 is a perspective view of an adjustable height desk in accordance with an embodiment of the present technology.

An alternative embodiment of an adjustable height desktop platform 301 is illustrated in FIGS. 23-25. Unless otherwise noted, the components of the embodiment of FIGS. 23-25 are similar to those of the embodiment of FIGS. 2-7 and 10-18. Moreover, reference numerals in FIGS. 23-25 similar to those in FIGS. 2-7 and 10-18 (i.e., increased by 100) are used to refer to analogous elements, and therefore such analogous elements may not be separately discussed below in connection with the embodiment of FIGS. 23-25. The principal difference between the embodiments described in FIGS. 23-25 and the embodiments described in FIGS. 2-7 and 10-18 is that structure of the height adjustment feature in FIGS. 23-25 (e.g., including crisscrossing linkages or telescoping legs) is used on adjustable height desks themselves as the mechanism for adjusting the height of the desk rather than on a desktop platform, as previously discussed.

An adjustable height desk 301 in accordance with an embodiment of the present technology is shown in FIGS. 23-24. The desk includes a table top assembly 303, a leg assembly 305, and a base 307. The leg assembly 305 may be an integrated assembly including multiple vertical legs 309 extending between the table top assembly 303 and the base 307, as well as one or more horizontal cross bars 311. The horizontal cross bar(s) 311 may be integrally connected to the legs 309 to form a single component, as shown in FIGS. 23-24. As also shown in FIGS. 24-25, the legs 309 may each comprise an inner tubular component 313 and an outer tubular component 315 that are telescopically arranged, so that the lengths of the legs 309 can be adjusted to vary the height of the table top assembly 303 from the base 307, and in turn the floor on which the base 307 is positioned. The tops of the inner tubular components 313 may be connected to the table top assembly 303, while the bottoms of the outer tubular components may be connected to the base 307. Moreover, the height adjustment may be driven by a mechanical height adjustment assembly 317, which may be electrically powered and controlled.

As shown in FIGS. 24-25, the height adjustment assembly 317 may include a motor 119, such as a DC-powered brushed, brushless, or stepper motor, which drives the rotation of a transverse drive shaft 321 that extends within a horizontal channel 323 (such as a U-shaped channel) extending between each leg 109 of the leg assembly 305. The horizontal channel 323 may extend from the inner tubular component 313 of one of the legs 309 on one side of the desk 101 to a housing 325 for the motor 319 on the other side of the desk. The horizontal channel 323 desirably protects the drive shaft 321 (e.g., during shipping and/or use) to prevent objects from coming into direct contact with the drive shaft 121, which might cause deformation of the shaft 321. The motor housing 319 may be attached to the inner tubular component 313 of the adjacent leg 309. The rotation of the drive shaft 321 drives the rotation of screw shafts 127 extending vertically within each of the legs 309. In order to transfer the rotation from the drive shaft 321 to the screw shafts 327, gear boxes 329 may be provided at the tops of each screw shaft 327, which gear boxes 329 may contain bevel gears, worm gears, universal joints, or any other suitable component for transferring the rotation of the drive shaft 321 approximately 90°. The screw shafts 327 are, in turn, received within posts 331 positioned within the inner tubular components 313 of the legs 309. The posts 331 have internally oriented threads for engaging with external threads of the screw shafts 327, such that rotation of the screw shafts 327 causes the screw shafts 327 to advance into or out of the posts 331, thus adjusting the heights of the legs 309. The legs 309 may also include hall effect sensors that act as proximity sensors to identify when the legs are near full extension and/or near full contraction, so as to send a signal to a control module 353 (discussed below) to stop further movement of the motor 319 in the expansion and/or contraction direction. For example, as shown in FIG. 25, a hall effect sensor 332 may be provided along one or both of the inner tubular components 313 of the legs 309, and associated magnets 334*a* and 334*b* may be provided along one or both corresponding outer tubular components 315. Magnet 334*a* may be positioned to identify maximum expansion of the legs 309, and magnet 334*b* may be positioned to identify maximum contraction of the legs 309. Thus, when the hall effect sensor 332 approaches one of the magnets 334*a*, 334*b*, the hall effect sensor 332 desirably provides a signal to stop further movement of the motor 319 in the current expansion or contraction direction.

An alternative embodiment of an adjustable height desk 601 is illustrated in FIGS. 26-30. Unless otherwise noted, the components of the embodiment of FIGS. 26-30 are similar to those of the embodiments previously described illustrated in FIGS. 23-25. Moreover, reference numerals in FIGS. 26-30 similar to those in FIGS. 23-25 are used to refer to analogous elements, and therefore such analogous elements may not be separately discussed below in connection with the embodiment of FIGS. 26-30.

Figure 27:
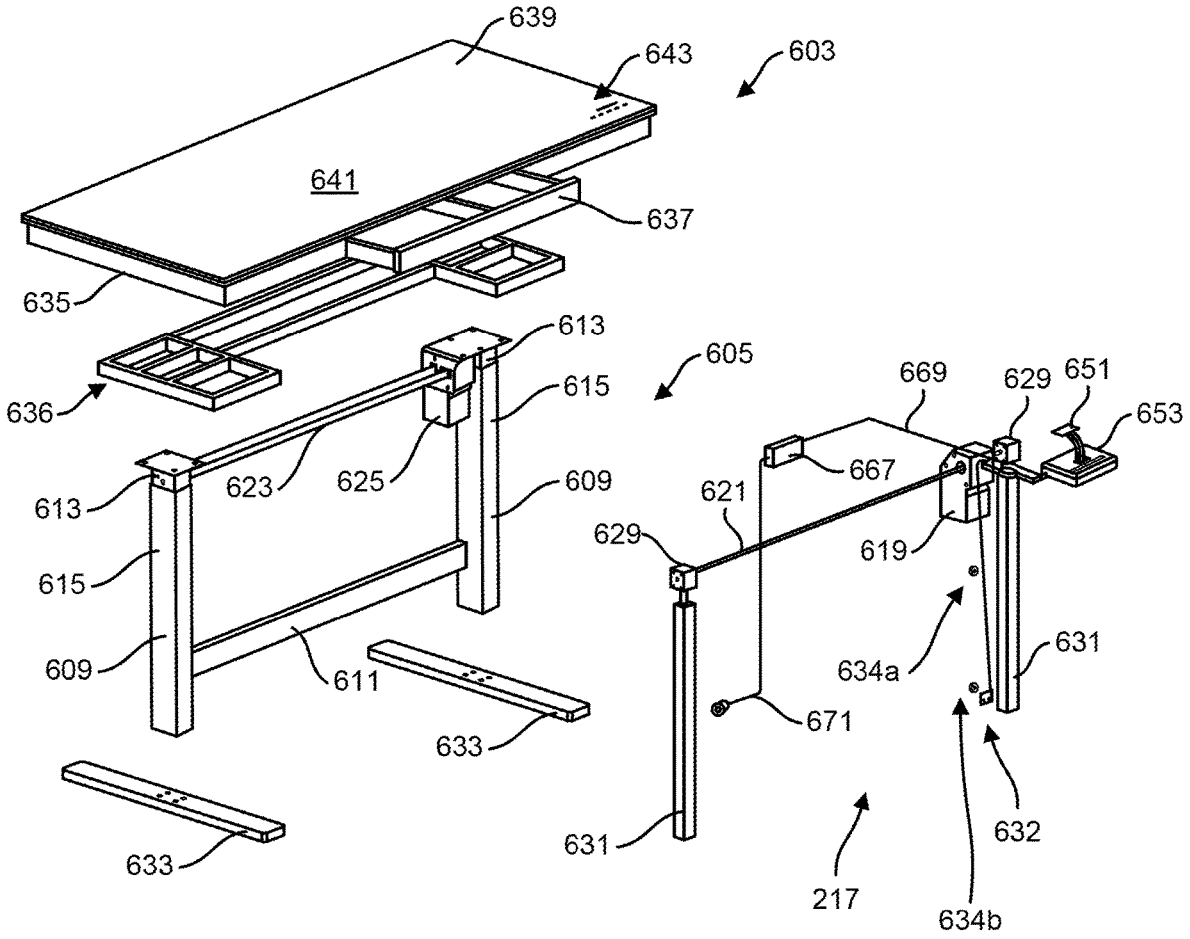
FIG. 27 is an exploded perspective view of an adjustable height desk in accordance with an embodiment of the present technology.
Figure 28:
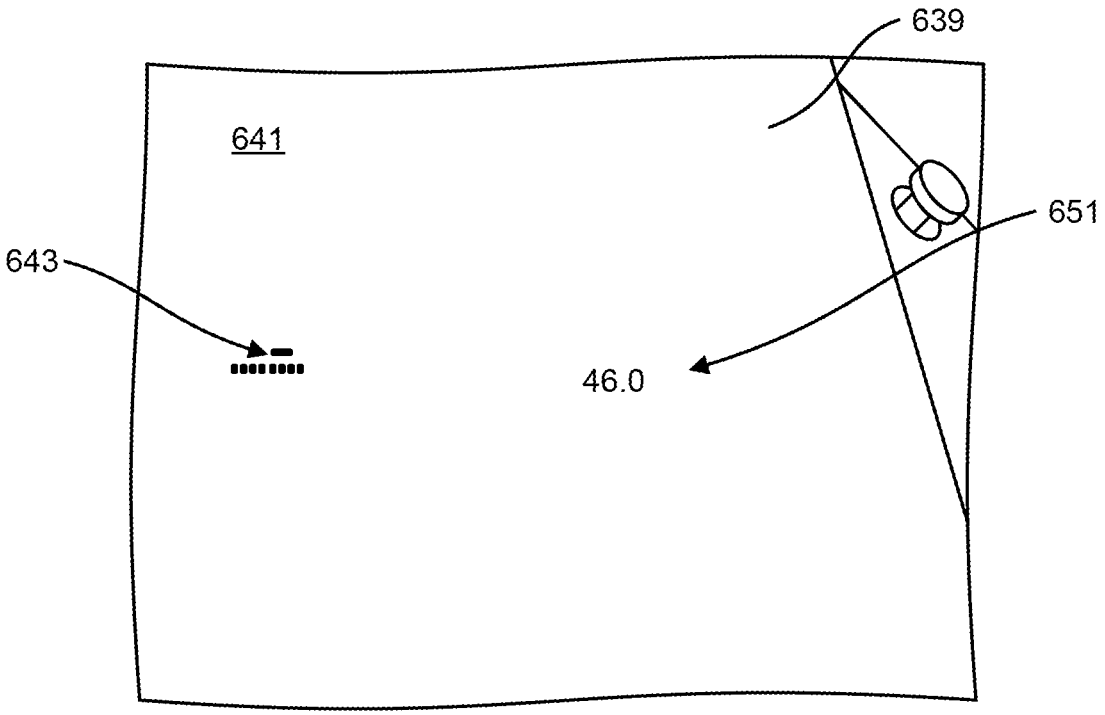
FIG. 28 is an enlarged top perspective view of an interface of the embodiment of the adjustable height desk of FIG. 26.
Figure 29:
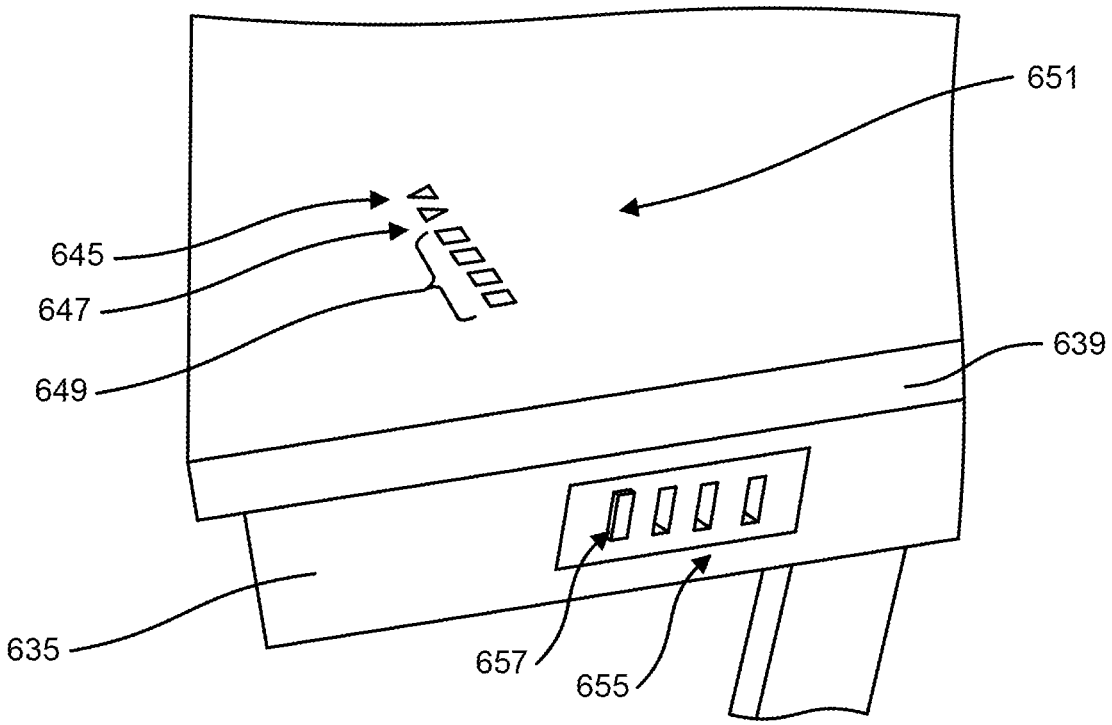
FIG. 29 is an enlarged side perspective view of an interface of the embodiment of the adjustable height desk of FIG. 26.

The primary difference between the embodiment of the adjustable height desk 601 in FIGS. 26-30 and the embodiment of the desk 301 in FIGS. 23-25 is that the desk 601 in FIGS. 26-30 is intended to look like a wood desk. Therefore, various components of the desk 601 are made, at least in part, of real or artificial wood, or they include exterior treatments (e.g., laminates or veneers) in order to resemble wood. As shown in 27, the top 639 and the apron 635 of the table top assembly 603 may be connected together. Moreover, as shown in FIG. 29, both the top 639 and the apron 635 resemble or are constructed from real wood. The internal framing structure 636 may or may not be constructed from wood. For example, the internal framing structure 636 may be constructed from steel, aluminum, or other metals, or it may be constructed from a metal-wood or wood composite or from solid wood.

As shown in FIGS. 28-29, the top surface 641 of the table top assembly 603 may provide an interface 643 for controlling and/or displaying various aspects and/or information regarding the configuration of the desk, in the same manner as that discussed above in connection with the embodiment of FIGS. 23-25. For example, as shown in FIGS. 28-29, the interface 643 may include one or more buttons for activation by a user in order to change one or more adjustable configurations of the desk, such as an 'up' button 645 and a 'down' button 647 in order to drive the motor 619 in the appropriate direction so as to raise or lower the table top assembly 603. As in the embodiment of FIGS. 23-25, one or more 'memory' buttons 649 may also be included in the interface 643, in order to store preprogrammed or user-programmable height set points for the table top assembly 603. In other examples, the adjustable configuration may be the angle of the table top or the locked/unlocked configuration of the wheels, as discussed above. The interface 643 may also include one or more displays 651 like those discussed above in connection with the previous embodiment, in order to provide information regarding an adjustable configuration of the desk 601.

Similar to the glass top embodiment 301 discussed above, the interface 643 of the wood top embodiment 601 may be flush with the top surface 641 of the table top assembly 603. For example, as shown in FIG. 29, a module 653 can be positioned underneath the top 639 and abutting the underside of the top 639, such that when the user presses an appropriate location on the top surface 641, the buttons 645, 647, 649 are activated. For example, the buttons may be capacitive buttons, such that the user can activate a desired button by pressing a finger on the top surface 641 of the top 639 directly above the button. In order to accomplish this, the top 639, at least in the region of the module 653, may be a thin wood (or artificial) veneer. In an embodiment, it may be glass or any other appropriate material. For example, the top 639 may have substantial thickness over its entire extent except for an area that defines a recess for receiving the module 653 directly underneath the thin veneer, which recess may be formed by routering away the material of the top 639 in the defined area. In one example, the recess is formed by first routering an opening completely through the material of the top 639 before applying the veneer over the entire top 639. In order keep the veneer flat during application (and avoid breakage, sinking, or other non-uniformity in the area of the routered opening), a supporting component should be positioned in the opening during the lamination of the veneer. That component could be the module 653 itself, which may be assembled to the top 639 before applying the veneer, or the component could be a temporary spacer that would be removed after the veneer is applied. That temporary spacer is desirably somewhat flexible and resistant to any heat that may be applied during veneer lamination, and it may be constructed, for example, from ethylene-vinyl acetate (EVA) polymer. Alternatively, if the module 653 itself is assembled to the top 639 before application of the veneer, the veneer may be applied using vacuum veneering or hand lamination, in order to avoid any possible heat damage to the module 653.

A display visible by the user through the wood veneer or any other appropriate material, including glass, on a surface of a product may featured in a variety of products, including, but not limited to, furniture or home goods, such as a desk, a chair, a shelf, a bed, a sofa, a table or any other appropriate furniture or home good; appliances such as a fireplace, a wine cooler, a refrigerator, a dishwasher, an oven, a microwave or any other appropriate appliance; an automobile; electronics, or any other appropriate items.

Any or all of the buttons discussed above may be visible through the wood veneer or glass as the buttons may also (or alternatively) be illuminated by the module, in order to increase visibility. The module can be programmed to turn on and off the illumination of the buttons and/or the display (e.g., by having the illumination fade out or fade in). For example, the illumination of the buttons and display can turn on or fade in when the buttons are activated by the user, and the buttons and display can turn off or fade out after a certain pre-set amount of time has elapsed since the buttons were activated by the user. That way, the illumination of the buttons and display is turned off when not in use, in order to save power and reduce any distraction that might be caused by such illumination. By having vanishing illumination, a user may see the buttons and/or display when needed for use but the vanishing capability maintains a non-technical furniture-like appearance of the product.

By arranging the module 653 underneath and abutting the underside of the top 639 (e.g., in a recess formed in the top 639, as discussed above), the display 651 may also be visible by the user through the wood veneer, or any other appropriate material, including glass, of the top 639. To avoid interference with the display 651 that might be caused by natural defects in the veneer, the veneer is desirably an engineered veneer. The top 639 may also be designed in such a way as to identify the locations of the buttons 645, 647, 649, such as by printing symbols and characters representing the up, down, and memory buttons 645, 647, 649 on the top surface 641 of the wood veneer. Such printing may be, for example, by laser engraving or silkscreen printing. Furthermore, in the case of silkscreen printing, a protective top coat can subsequently be added to the top 639 in order to prevent the printed matter from being scraped off during use. In another example, the symbols and characters representing the various buttons on the top surface 641 may be formed by inlays, such as metallic or veneer inlays.

Similar to the glass top embodiment 301, the buttons 645, 647, 649 of the wood top embodiment 601 may also (or alternatively) be illuminated by the module 653. Moreover, the module 253 of the wood top embodiment can operate in the same manner as the glass top embodiment 301, including the fade in/out of the illumination, as well as the operation of the ports 655 and locking control 657.

Figure 30:
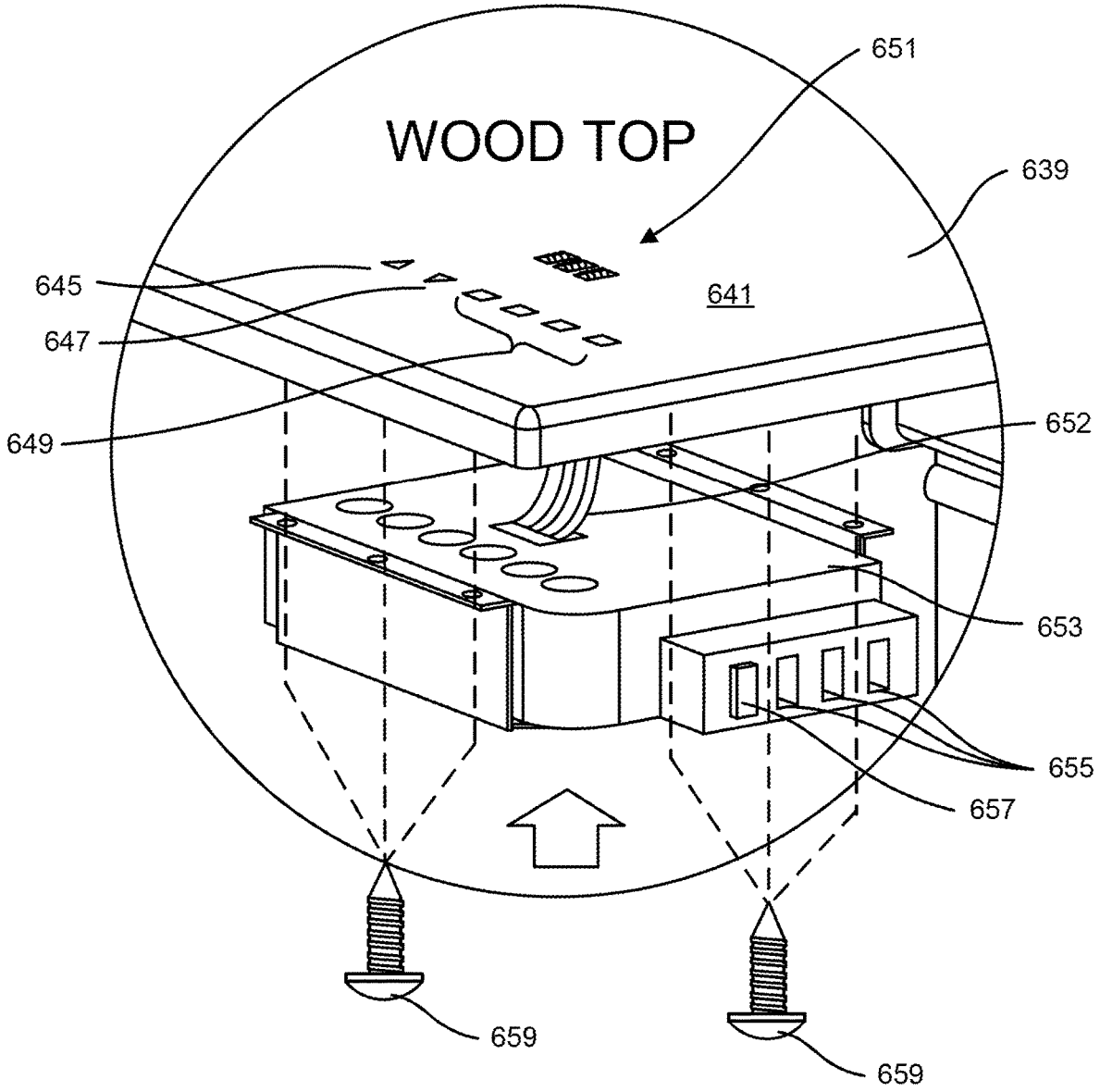
FIG. 30 is an enlarged, exploded perspective view of the interface module and associated components of the embodiment of the adjustable height desk of FIG. 26.

As shown in FIG. 30, the module 653 in the wood top embodiment 601 may be assembled within the table top assembly 603, underneath the wood top 639, and within the thickness provided by the apron 635. The module 653 may be attached (e.g., with screws 659) to the underside of the wood top 639. Moreover, as shown in FIGS. 27 and 30, the display 651 (e.g., illuminated seven-segment display) of the wood top embodiment 601 may be separable from the housing of the module 653 (although it is connected to the module 653 by electrical connections 652). That way, the display 651 can be affixed to the underside of the top 639, preferably to a particularly thin portion comprising just veneer, such that the display 651 can be visible by the user through the veneer.

The electrical components of the wood top embodiment 601 may be configured and arranged in the same manner as those of the glass top embodiment 301. Moreover, the components of the wood top embodiment 601 may be disassembled and stacked for shipping as needed.

Figure 31:
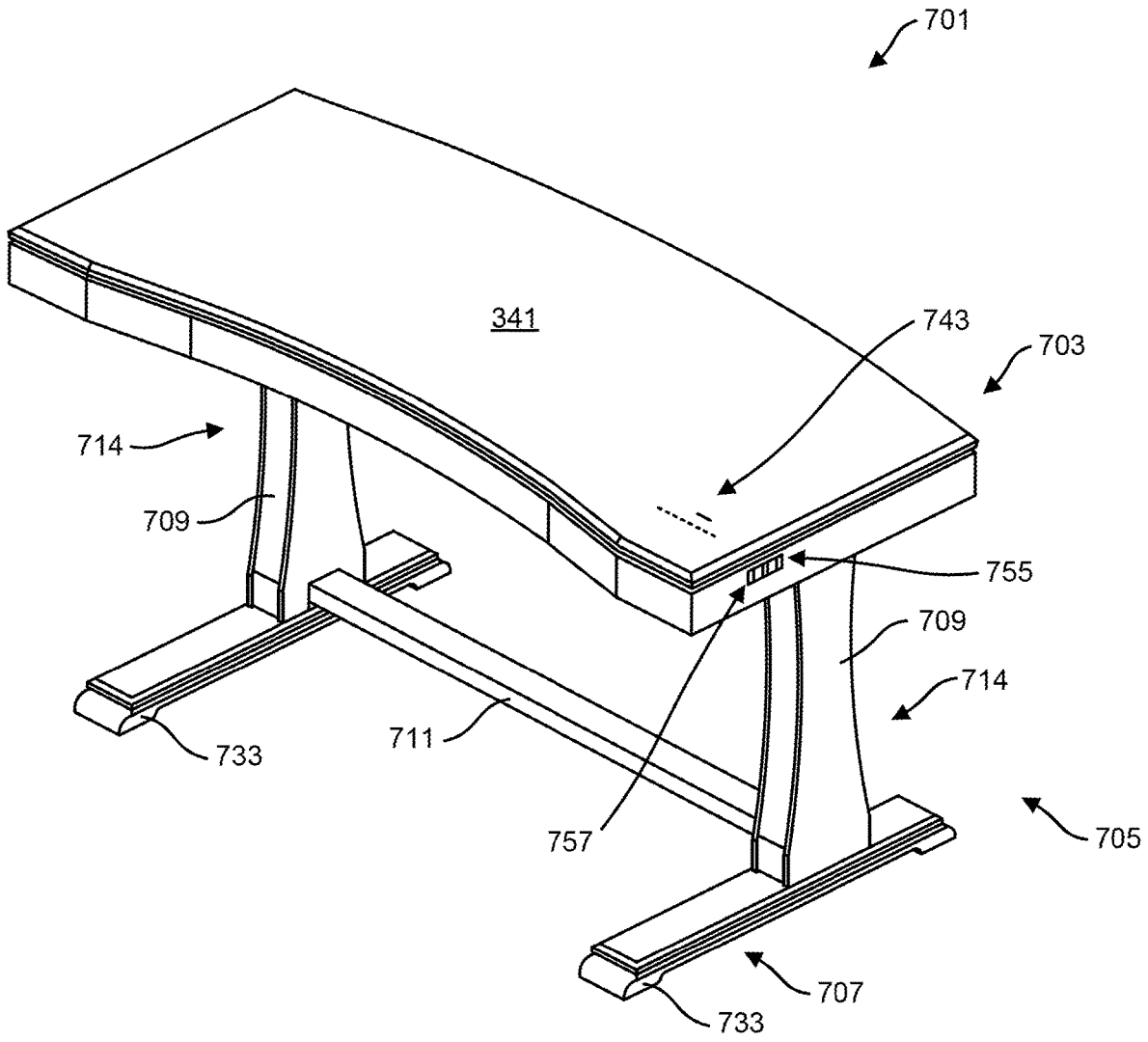
FIG. 31 is a perspective view of an adjustable height desk in accordance with an embodiment of the present technology.
Figure 32:
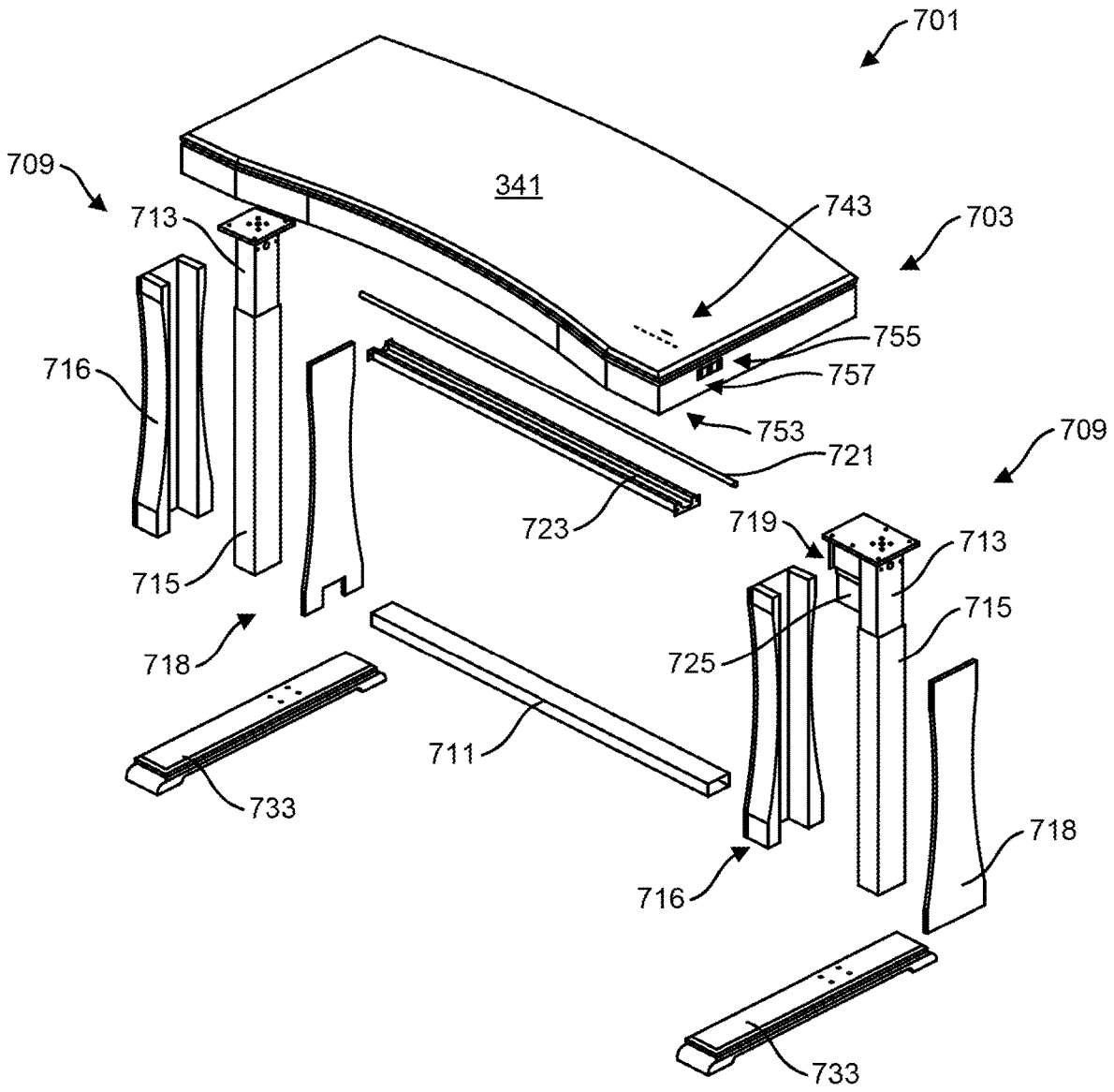
FIG. 32 is an exploded perspective view of the adjustable height desk of FIG. 26.

An alternative embodiment of an adjustable height desk 701 is illustrated in FIGS. 31-32. Unless otherwise noted, the components of the embodiment of FIGS. 31-32 are similar to those of the embodiments previously described illustrated in FIGS. 23-25. Moreover, reference numerals in FIGS. 31-32 similar to those in FIGS. 23-25 are used to refer to analogous elements, and therefore such analogous elements may not be separately discussed below in connection with the embodiment of FIGS. 31-32.

The primary difference between the embodiment of the adjustable height desk 701 in FIGS. 31-32 and the embodiment of the desk 301 in FIGS. 23-25 is that the desk 701 in FIGS. 31-32 includes additional decorative components to modify the outward appearance of the legs 709. For example, the legs 709 may include a decorative shell 714 comprising a trough member 716, which has a channel for receiving the outer tubular component 715, and a facing piece 718 that joins with the trough member 716 to complete the enclosure defined by the shell 714. The subcomponents of that decorative shell 714 may be formed from solid wood or wood composite, or they may also be formed from a resin, foam, or polymeric material. The decorative shell 714 may be securely attached to the outer tubular component 715 of the leg 709, such as by adhesive bonding. The decorative shell 714 may further include decorative trim (not shown) along its outer surface to provide visual interest and/or to mimic traditional wood furniture. That decorative trim may be applied to the outer surface of the shell 714 (e.g., after the shell 314 has been attached to the tubular component), or the trim may be integrally formed with the subcomponents of the shell 714. The shell 714, like the other wood-like components of the desk, may also have an outer finish applied to it, such as nitrocellulose lacquer. As also shown in FIGS. 31-32, different embodiments of the adjustable height desk may have a differently shaped table top assembly 703.

In yet another embodiment (not shown), instead of the shell 714 being assembled from subcomponents such as a trough member 716 and a facing piece 718, as shown in FIGS. 31-32, the shell may instead comprise materials that may be cast or molded, such as resin, foam, or polymeric materials. In such an embodiment, the shell may be cast/molded around the outer tubular component 715. The shell may also include the decorative trim (not shown) along its outer surface, such as by integrally forming the trim with the shell during the casting/molding process or by applying the trim to the outer surface.

In any of the above embodiments, the motor 319, 619, 719 may be, for example, powered by a 60 W supply, which may be provided and controlled by the module 353, 653, 753. That available power could then be used to power various other devices when the motor 319, 619, 719 is not running. For example, the ports 355, 655, 755 which may be 2 amp USB charging ports, may draw on the same power supply used to supply power to the motor 319, 619, 719. That same power supply could also be used for many other devices, which may be connected to and even controlled by the module 353, 653, 753 such as lights, speakers, a heating and/or cooling function of a desk component like a cup-holder, etc. The module 353, 653, 753 can thus be programmed to cut off the power supply to those other devices when the motor is running, such that the available power is only supplied to the motor during its operation, and then the power can be returned to those other devices when the motor stops. In that way, those ancillary devices can share the single power source used to power the motor, which may beneficially allow the adjustable height desk to include those other electrically powered features at lower cost (i.e., without the need for separate drivers for each of the different components). Moreover, as the motor 319, 619, 719 for adjustment of the height of the desk is likely to be used relatively infrequently (at least compared to the usage of those other ancillary devices), the temporary interruption of the power supply to at least some of those devices during motor operation is not likely to be a significant inconvenience to the user.

The power supply for the motor 319, 619, 719 and other ancillary devices, as discussed above, could also be provided by a rechargeable battery (not shown) that is incorporated into the desk. For example, the electrical connections 369, 669, 779 in the underside of the table top assembly may be connected to a battery that is chargeable when the plug cable 371, 671, 771 or when another cable (not shown) which is dedicated to charging the battery, is connected to an AC power outlet. Such battery may provide mobile power to the desk and its components when the desk is moved. Thus, such battery may provide electrical power to the ports 355, 655, 755 and/or other outlets incorporated into the desk, such as outlets having standard connectors (not shown) for providing power to components (e.g., printers) that might travel with the desk.

In any of the embodiments, the system may be operated by a remote device, including, but not limited to, a remote controller, application on a smart phone or tablet, a computer or other device connected to the system via a wireless or wired connection. In an embodiment, the system is connected by a remote device to the control module.

Although the embodiments of the adjustable height desk disclosed herein were illustrated telescoping legs in order to vary the height of the table top assembly, the present technology is not limited to that type of expansion. Various alternative expanding mechanisms could alternatively be used in connection with other features of the technology disclosed herein in order to adjust the height of the desk.

Although the embodiments of the present disclosure have been illustrated in the accompanying drawings and described in the foregoing detailed description, it is to be understood that the present disclosure is not to be limited to just the embodiments disclosed, but that the present disclosure described herein is capable of numerous rearrangements, modifications and substitutions without departing from the scope of the claims hereafter. The claims as follows are intended to include all modifications and alterations insofar as they come within the scope of the claims or the equivalent thereof.

Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A desk system having an adjustable configuration, comprising:

a table top having an upper surface, wherein the upper surface is planer and wherein the upper surface comprises:

a first layer of glass comprising the upper surface;

a second layer of glass; and an interface comprising a plurality of capacitive buttons adapted to be activated by a user, and a control module communicatively coupled to the plurality of capacitive buttons and operatively receiving signals from the plurality of capacitive buttons to control adjustments of at least one configuration of the desk, wherein the plurality of capacitive buttons are disposed beneath the first layer of glass and within apertures formed through the second layer of glass, such that the upper surface is seamless so that it remains planer over the interface; and a supporting leg assembly connected to the table top for supporting the table top off of a floor surface on which the leg assembly is positioned.

2. The desk of claim 1, wherein the at least one configuration of the desk is a height of the table top off of the floor surface.

3. The desk of claim 2, wherein the supporting leg assembly includes a plurality of telescoping vertical legs connected together by at least one horizontal member.

4. The desk of claim 3, wherein the horizontal member defines an internal channel for receiving a rotatable drive shaft that drives the telescoping of the vertical legs.

5. The desk of claim 1, further comprising a locking control adapted to be activated to temporarily disable the interface.

6. The desk of claim 1, further comprising an electronic display adapted to display information regarding a current status of the at least one configuration of the desk.

7. A desk system having an adjustable configuration, comprising:

a table top having an upper surface comprising a glass layer and an opposite lower surface, wherein the upper surface is planer;

a control module configured against the lower surface of the table top and abutting the underside of the upper surface, wherein an interface comprises an electronic display adapted to display information regarding a current status of at least one configuration of the desk, and wherein the interface is viewable from the upper surface through the glass layer; and wherein at least one button of the control module is operatively activatable through the upper surface of the table top, and wherein the upper surface is seamless over the control module so that it remains planer.

8. The desk system of claim 7, wherein the table top further comprises a layer of pigment.

9. The desk system of claim 7, wherein the table top further comprises a layer of veneer.

10. The desk system of claim 7, wherein an area of the glass layer that abuts the interface is flush with the rest of the upper surface of the table top.

11. The desk system of claim 7, wherein the at least one button is a capacitive button.

12. The desk system of claim 7, wherein the at least one button operatively controls adjustability of the desk system.

13. The desk system of claim 7, wherein a remote device is operatively connected to the control module.

14. The desk system of claim 7, wherein the electronic display comprises vanishing illumination.

15. The desk system of claim 7, wherein the at least one button of the control module is locked preventing operation of the adjustable configuration.

16. The desk system of claim 7, wherein the at least one button of the control module is unlocked allowing operation of the adjustable configuration.

* * * * *